US011242859B2

(12) United States Patent
Yi

(10) Patent No.: US 11,242,859 B2
(45) Date of Patent: Feb. 8, 2022

(54) VERTICAL LIGHTING VANELESS INVERTER FAN

(71) Applicant: Yangbo Yi, Foshan (CN)

(72) Inventor: Yangbo Yi, Foshan (CN)

(73) Assignee: Guangdong Letme Smart Home Technology Co., Ltd, Foshan (CN)

( * ) Notice: Subject to any disclaimer, the term of this patent is extended or adjusted under 35 U.S.C. 154(b) by 60 days.

(21) Appl. No.: 16/792,898

(22) Filed: Feb. 18, 2020

(65) Prior Publication Data

US 2021/0254625 A1 Aug. 19, 2021

(51) Int. Cl.

| | |
|---|---|
| ***F21V 33/00*** | (2006.01) |
| ***F04D 25/08*** | (2006.01) |
| ***F04D 29/52*** | (2006.01) |
| ***F04D 19/00*** | (2006.01) |
| ***F04D 29/66*** | (2006.01) |
| *F21Y 115/10* | (2016.01) |

(52) U.S. Cl.

CPC ..... *F04D 25/088* (2013.01); *F04D 19/002* (2013.01); *F04D 29/522* (2013.01); *F04D 29/664* (2013.01); *F21V 33/0096* (2013.01); *F21Y 2115/10* (2016.08)

(58) Field of Classification Search

CPC ..... F21V 29/02; F21V 29/40; F21V 29/60; F21V 29/67; F21V 33/0096; F21V 33/0088; F21V 33/0092; F04D 25/088; F04D 19/002; F04D 29/522; F04D 29/664; F21S 8/086; F21S 8/08; F21S 8/088; F21S 13/10

See application file for complete search history.

(56) References Cited

U.S. PATENT DOCUMENTS

| | | | | |
|---|---|---|---|---|
| 3,104,307 | A * | 9/1963 | Garofalow | F21V 33/0092 219/220 |
| 5,603,562 | A * | 2/1997 | Huang | F21S 6/007 362/183 |
| 6,912,408 | B1 * | 6/2005 | O'Neill | H01Q 1/12 455/561 |
| 2007/0109797 | A1 * | 5/2007 | Reda | F21V 21/40 362/418 |
| 2021/0116088 | A1 * | 4/2021 | Bijl | F21S 8/088 |

* cited by examiner

*Primary Examiner* — Y M. Quach Lee

(57) ABSTRACT

A vertical lighting vaneless inverter fan comprises a body, a blast system, an air supply column, a lighting device and a sound-reducing structure. The blast system is mounted in the inner chamber of body. The air supply column is installed on the top of body. The blast system supplies air to the air supply column, the airflow is jetted from the air supply column. The impeller is located above the motor. When the blast system is installed in the inner chamber of body case, the impeller corresponds to the bottom of air outlet, so that the wind can be delivered through the air outlet directly.

16 Claims, 26 Drawing Sheets

Prior Art

VERTICAL LIGHTING VANELESS INVERTER FAN

BACKGROUND OF INVENTION

1. Field of the Invention

The present invention relates generally to the technical field of vaneless fans, and more particularly to a vertical lighting vaneless inverter fan.

2. Description of Related Art

In the existing technology, the vaneless fans include annular vaneless air supply tan and vertical vaneless air supply fan. An annular vaneless air supply fan is provided with a base, a body and an annular nozzle for supplying air which is supported by the body. A vertical vaneless fan is provided with a base, a body and a vertical air supply column for supplying air. The annular vaneless fan or the vertical vaneless fan generates wind using the lower body which contains a motor and an impeller, the wind is fed into the upper air supply device, and delivered by the upper air supply device.

For example, Chinese patent CN201711097261X discloses a vertical vaneless fan, please refer to FIG. 1 and FIG. 2 of this project, which comprises a body 1 and a vertical air supply column 2 located at the upper end of body 1, a motor 4 and an impeller 3 for generating airflow are located in body 1; the air intake bottom plate 13 is provided with an air inlet 11, the air inlet 11 is a conventional small round hole air intake grille.

This inventor found in the process of research and development that the vaneless fans in the patent and in the existing technology have the following problems, further improvement is required.

1. As shown in FIG. 1, the motor 4 is located above the impeller 3, and all the vaneless fans use the structure comprising a body in the lower part and an air supply device in the upper part. Therefore, the impeller rotates to deliver air upwards, the motor mounting frame is on the air supply path, obstructing the airflow blown by the impeller, the kinetic energy of air molecules will be reduced, the supply air velocity and air output are reduced; the air output is obstructed.

2. As shown in FIG. 2, the air inlet 11 is a conventional small-round-hole air intake grille, generally Φ3-5 mm, difficult to clean, the small round holes are likely to be blocked by dust and foreign matter after a period of time, the air input decreases, and the air output decreases accordingly. As the air inlet partition is provided with a small-round-hole air inlet, and the round holes are likely to be blocked, the whole air inlet partition shall be removed before cleaning, and it shall be mounted again after cleaning, the dust removal is very inconvenient.

3. The blades of vaneless fans of the existing technology are mounted at the bottom of motor, so that the running noise can be sent outwards with the air supplied from the impeller, the noise reduction is poor.

4. The vaneless fan of the existing technology has simple function, it only supplies air without lighting function.

SUMMARY OF THE INVENTION

In view of this, the present invention provides a vertical lighting vaneless inverter fan.

The beneficial effects of the present invention are expounded in the following specific embodiments.

A vertical lighting vaneless inverter fan, comprising:

a body, including a body case, a blast system disposed in the body case; an air outlet formed on a top of the body case; an air inlet formed below the air outlet of the body case; wherein the blast system includes a motor and an impeller driven by the motor; the motor is fixed in the body ease through a motor mounting bracket, and the impeller is located above the motor and directly transmits wind to the air outlet;

an air supply column, which is a straight tube and disposed at a top of the air outlet of the body case to directly deliver wind outward;

a lighting device, including a lamp post and an illuminating lamp disposed on a top of the lamp post; wherein the lamp post is in a straight pipe and is disposed at a top of the air supply column to linearly connect with the air supply column; the light of the illuminating lamp is emitted to the surroundings.

More particularly, wherein the top of the air supply column and the lamp post are detachably connected through a connector.

More particularly, wherein the illuminating lamp includes a lamp housing and a luminous element disposed inside the lamp housing; the lamp housing is detachably assembled on the top of the lamp post, and the light of the luminous element are diffused through the lamp housing.

More particularly, wherein the lamp housing includes a mounting slot and a reading light detachably mounted in the mounting slot.

More particularly, wherein a bottom of the body case is open, which includes an air inlet partition and the air inlet formed on the air inlet partition.

More particularly, wherein the air inlet partition is in an annular shape, includes an annular upper spacer, an annular lower spacer, and a dust screen; the upper spacer and lower spacer are detachably connected by stacking; the upper spacer and lower spacer separately include the air inlet; the dust screen is disposed between the upper spacer and lower spacer; when the upper spacer and lower spacer are disassembled and opened, the dust screen can be removed and replaced.

More particularly, wherein the upper spacer and the lower spacer include a plurality of partition bars in a circumferential interval between an inner ring and an outer ring, and a gap between adjacent partition bars forms a long fan-shaped air inlet.

More particularly, wherein motor mounting bracket includes a cover, an inside of the cover is a hollow motor mounting position, an lower end face of the cover is an open structure for disassembling motor, the motor is assembled in the motor mounting position through the opening at the lower end of cover, an output shaft, of motor extends upward through a top of the cover.

More particularly, wherein a bottom of the cover is installed in an annular center of the air inlet partition, and the cover is evenly provided with heat dissipation holes.

More particularly, wherein an inner wall of the cover includes a first sound-reducing cotton.

More particularly, wherein an inside the body case is configured with a sound-reducing structure; the sound-reducing structure has a sound-reducing chamber and the sound-reducing chamber includes the blast system.

More particularly, wherein the sound-reducing structure includes a truncated cone shaped sound-reducing mount, a second sound-reducing cotton mounted an outside of the sound-reducing mount, and a sound-reducing chamber disposed inside the sound-reducing mount; the inside of the sound-reducing mount is attached to the outer wall of the sound-reducing mount; the outer side of the sound-reducing mount is disposed with a plurality of annular wave patterns.

More particularly, wherein the upper end and lower end of the sound-reducing mount are respectively disposed with a supporting ring towards the outer ring to press against the body case; an installation space with second sound-reducing cotton is configured between the upper and lower supporting ring plate;

a mount air outlet is provided at the top of the sound-reducing mount; the mount air outlet can link up with the air outlet of the body case; the sound-reducing mount is disposed with an open configuration, which is provided with a blast system inside the sound-reducing chamber.

More particularly, wherein the air supply column is configured on the air outlet of the body case through a joint sleeve, the air supply column including:

an outlet tube, an opening is provided lengthways along the side of the outlet tube and is connected to the inside of the outlet tube;

an air guide component, which is laterally inserted in the opening of outlet tube; an air guide face is formed, on the air guide component;

a narrow air supply slit is formed between the tube wall at the opening of the outlet tube and the air guide face of the air guide component.

More particularly, wherein air guide component forms a dual-inlet space inside the outlet tube, and the outlet slit corresponds to the configuration of the inlet space; the outlet tube has a C-shaped tube, bending and extending inwards along the opening of tube to form two symmetrical side plates; the air guide component is located between the two side plates in the outlet tube;

the air guide component has two air deflectors corresponding to side plate, and the narrow air supply slit is formed between the side plate and air deflector; the air guide face is formed on the air deflector, and the airflow in the outlet tube is guided by the air guide face and jetted out of the narrow air supply slit;

a slot is provided in the inner wall of tube, the edges of air deflector are inserted in the slots to assemble the air guide component.

More particularly, wherein the air supply column is connected to the body case by a joint sleeve, the top of the joint sleeve is provided with a plug hole for assembling the air supply column and matching the shape of air supply column: the joint sleeve is assembled at the top of body case and connected to the air outlet of body case; the air supply column is connected to the air outlet of the body case by the joint sleeve;

the end wall of body case is provided with positioning lugs with cylindrical slots, correspondingly, plug pins are disposed at the bottom of the joint sleeve, the plug pins are inserted in the cylindrical slots of the positioning lugs to guide the joint sleeve to the top of the body case;

a groove is provided downward of the end wall of the body case, an elastic buckle is located in the groove; the top of the joint sleeve is provided with a buckle part matching the elastic buckle, the elastic buckle and buckle part coordinate with each other to affix the joint sleeve to the top of body case.

More particularly, wherein the inside of the body is provided with circuit module; the lighting device is electrically connected to the circuit module inside the body; the inside of the lamp housing of the lighting device is provided with independent circuit module; the body is disposed with a control panel.

More particularly, comprising a base, the body is rotatably mounted on the base.

DETAILED DESCRIPTION OF THE INVENTION

Figure 3:
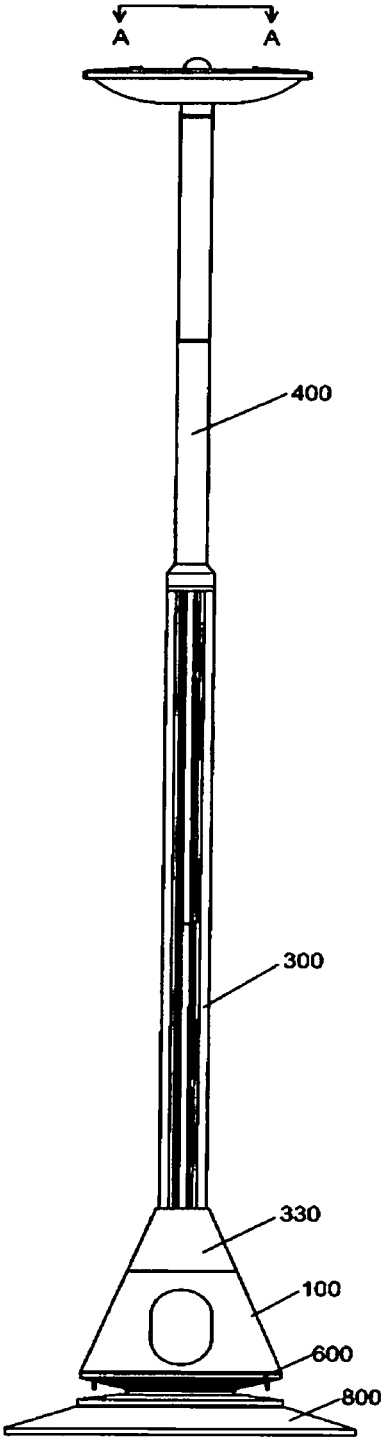
FIG. 3 is a structural representation of front side of the present invention.
Figure 4:
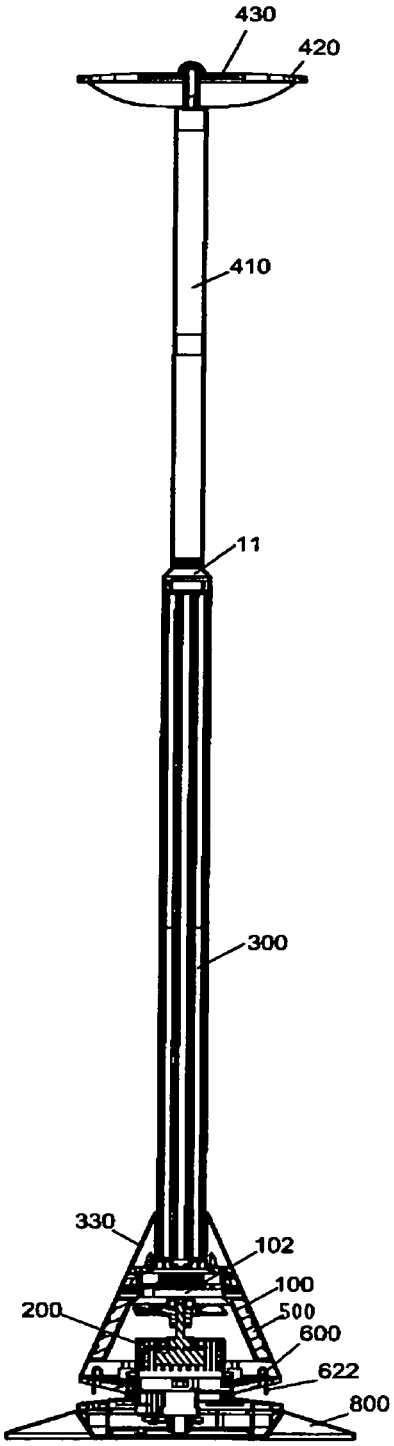
FIG. 4 is a sectional of A-A' in FIG. 3.

As shown in FIGS. 3-4, a vertical lighting vaneless inverter fan comprises a body 100, a blast system 200, an air supply column 300, a lighting device 400 and a sound-reducing structure 500. The blast system 200 is mounted in the body 100. The air supply column 300 is mounted at the top of body 100, the blast system 200 supplies air to the air supply column 300, the airflow is jetted from the air supply column 300.

Figure 5:
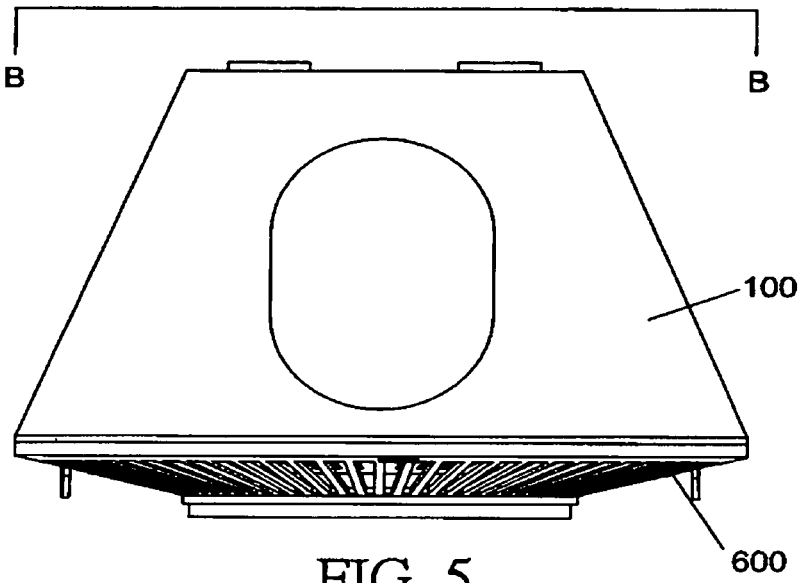
FIG. 5 is a structural representation of front side of the body in the present invention.
Figure 6:
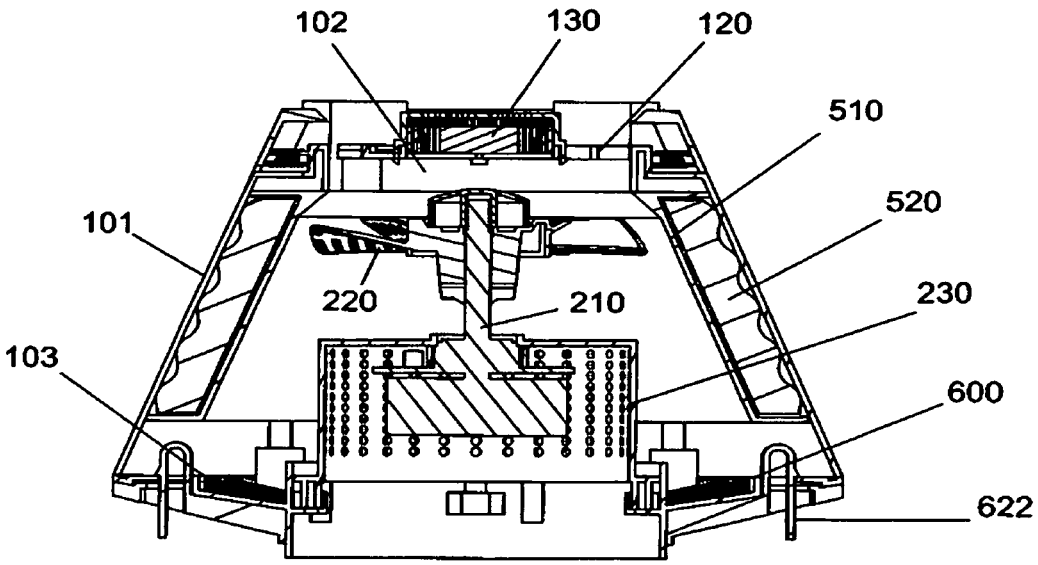
FIG. 6 is a sectional view of B-B' in FIG. 5.

As shown in FIGS. 5-6, the body 100 has a body case 101, a storage chamber for assembling the blast system 200 is formed inside the body case 101, an air outlet 102 is formed at the top of body case 101, an air inlet 103 is formed under the air outlet of body case 101, the air is pumped from the bottom and delivered upwards, meaning the air is fed into the air inlet 103 and discharged via the air outlet 102.

The body case 101 is truncated cone shaped in this embodiment, it can be in other shapes in fact.

The blast system 200 comprises a motor 210 and an impeller 220. The blast system 200 is fixed into the body case 101 by a motor mounting bracket 230; the motor 210 is fixed to the motor mounting bracket 230, the upper end of output shaft of motor 210 is oriented upwards; the impeller 220 is located above motor 210 and fixed to the upper end of output shaft of motor 210. When the blast system 200 is installed in the inner chamber of body case 101, the impeller 220 corresponds to the lower part of air outlet 102, so that the wind can be delivered through the air outlet 102 directly.

Figure 1:
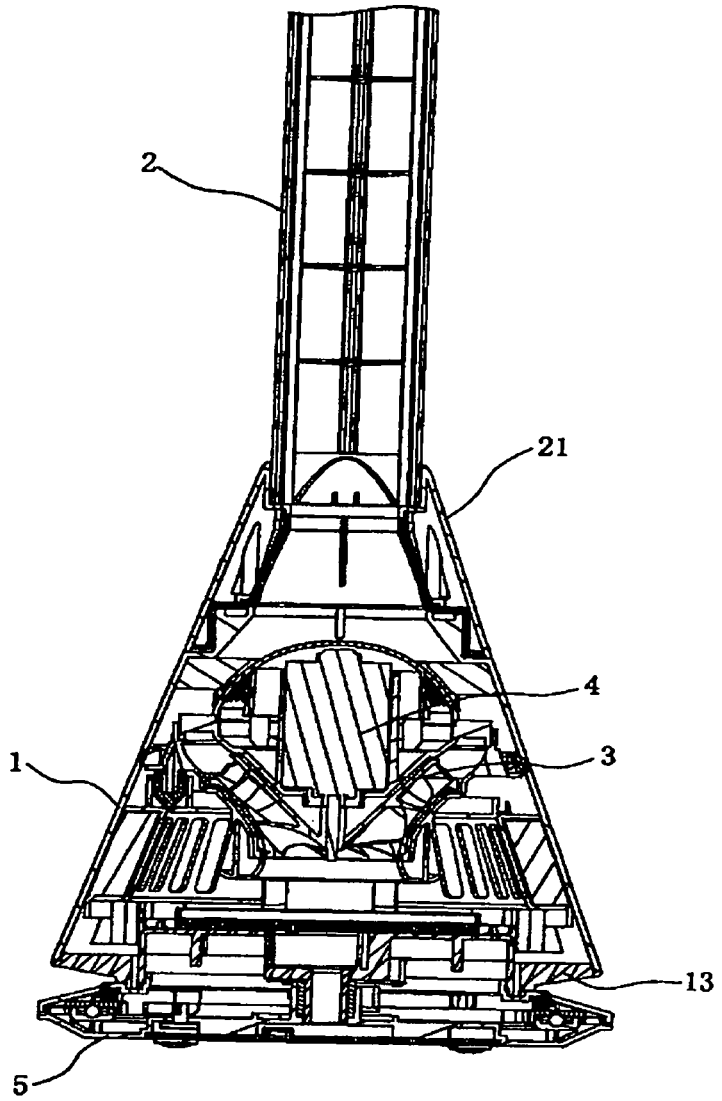
FIG. 1 is a structural representation of the vertical vaneless fan in prior project stated in the background technology of this project.
Figure 2:
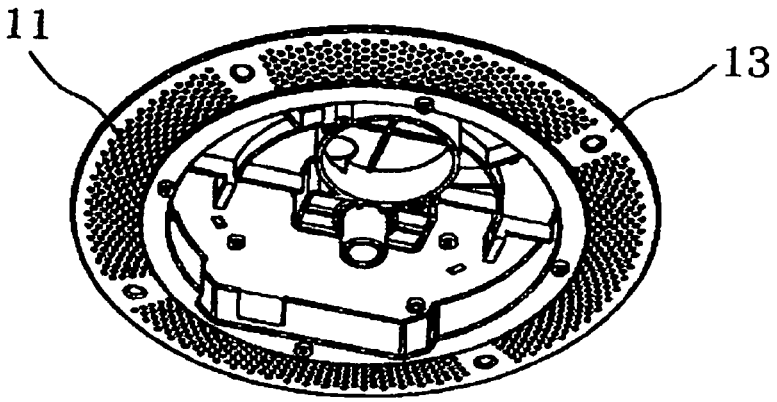
FIG. 2 is a structural representation of the air inlet partition of vertical vaneless fan in prior project stated in the background technology of this project.

FIG. 1 shows a vaneless fan of the existing technology, the fan comprises a body 1, a base 5, an air supply device 2 and an air supply device 2 connection element 21; wherein the air is pumped from the bottom and delivered upwards; the motor 4 mounting frame is on the blowing path of impeller 3, so that the impeller blown airflow is obstructed, the kinetic energy of air molecules is reduced, the supply air velocity and air output are reduced. In terms of this application, as shown in FIG. 6, the motor mounting frame is placed above the impeller, when the impeller delivers airflow upwards, the motor mounting frame does not obstruct the airflow blown by the impeller anymore; so that the air volume and air velocity of impeller are increased greatly.

Figure 7:
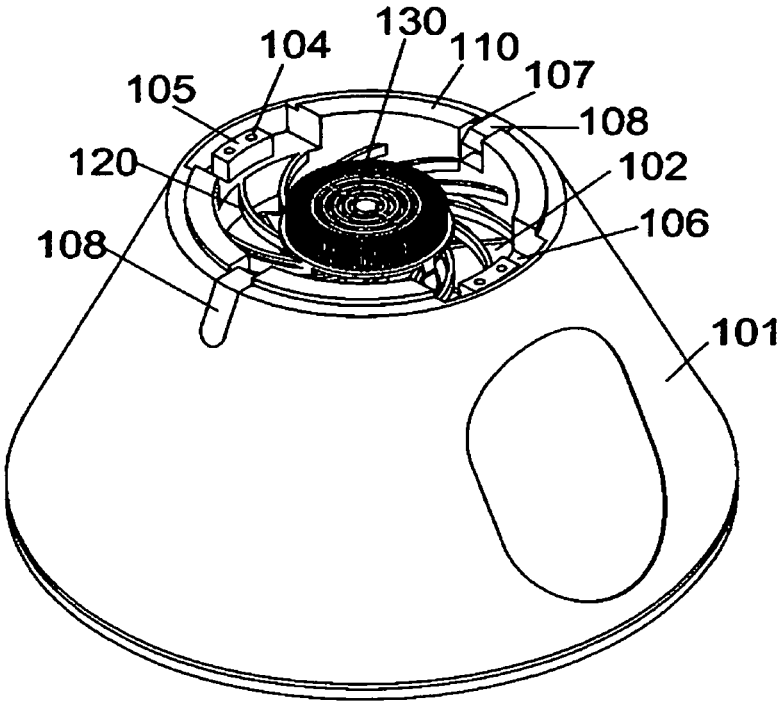
FIG. 7 is a structural representation in axial direction of body in the present invention.
Figure 8:
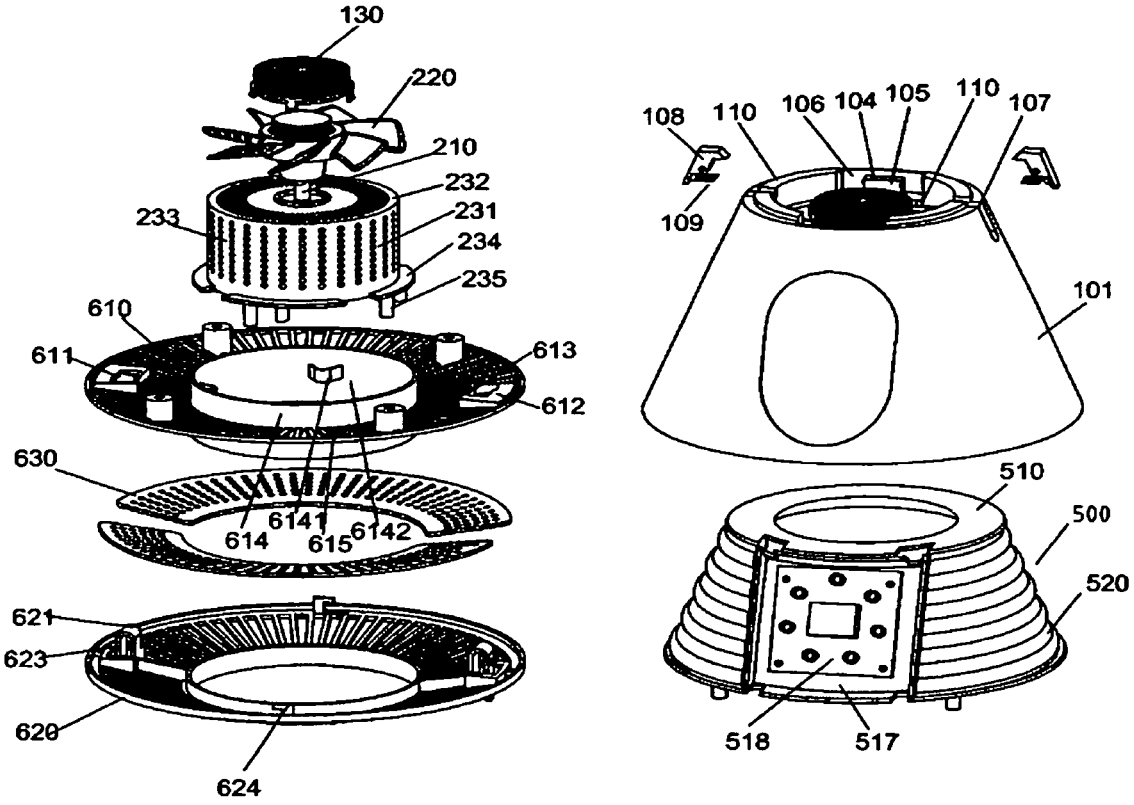
FIG. 8 is a structural representation of body in exploded state in the present invention.
Figure 9:
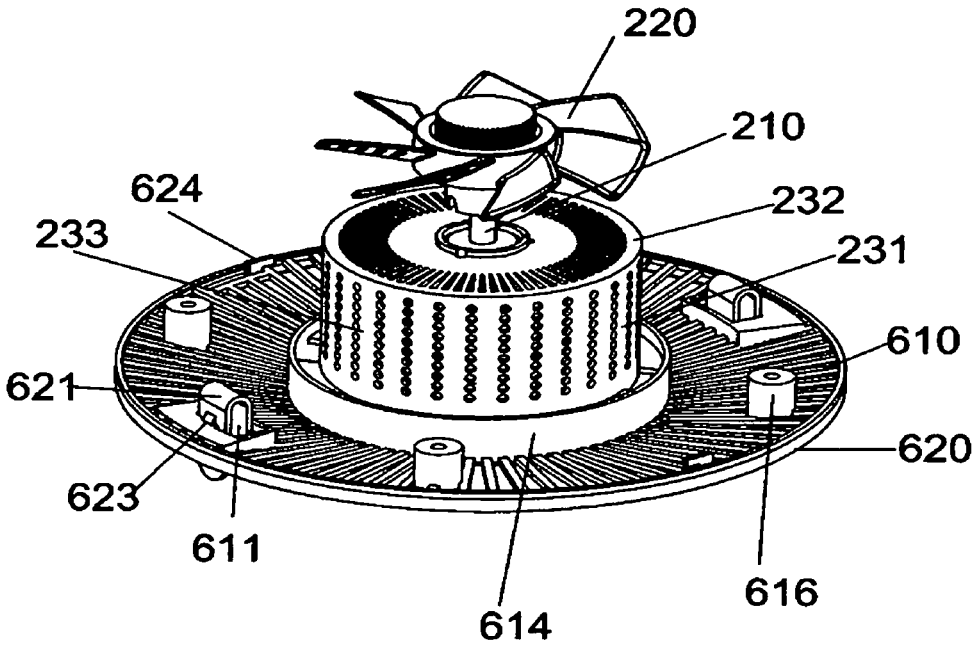
FIG. 9 is a structural representation of air inlet partition and blast system in combined state in the present invention.

As shown in FIGS. 7-9, the lower end of body case 101 is an open structure for assembling the blast system 200 and sound-reducing structure 500. An air inlet partition 600 is provided at the opening, the air inlet 103 is formed in the air inlet partition 600.

The main body of air inlet partition 600 is annular, comprising an annular upper spacer 610 and an annular lower spacer 620; the upper spacer 610 and lower spacer 620 are vertically stacked up and detachable; the air inlet 103 is provided in the upper spacer 610 and lower spacer 620 respectively.

In an embodiment, there are several partition bars spaced circumferentially between the inner ring and outer ring of the upper spacer 610 and the lower spacer 620, the gap between adjacent partition bars is a long fan-shaped air inlet 103.

In the case of the long fan-shaped air inlet 103 of the structure, the air inlet 103 is large, the air intake effect is certainly favorable, but the dust and fine sweeps are likely to enter the body case 101 via the air inlet 103, influencing the operation of blast system 200. Therefore, a dust screen 630 can be provided between the upper spacer 610 and lower spacer 620.

It is noteworthy that due to the dust screen 630, the air inlet 103 in the lower and upper spacers 620, 610 shall be large enough, so that the air inlet 103 in the lower and upper spacers 620, 610 will not be blocked, the dust adheres to the dust screen 630, convenient for cleaning. To be specific, the air inlet 103 in the lower and upper spacers 620, 610 can be set as large circular holes or large square holes, as long as there is a certain area of air intake.

The lower bound of air inlet 103 is that it is unlikely to be blocked by dust after a long period of operation, and the upper bound is that the support structure between holes can support the dust screen 630, so that the dust screen 630 can be clamped between the upper and lower spacers 610, 620.

The upper spacer 610 and lower spacer 620 are superposed, there shall be a linkage structure between upper spacer 610 and lower spacer 620. The linkage structure can be a simple buckle 621, side lock or screwing is available, as long as the upper spacer 610 and lower spacer 620 are locked up.

When the lower spacer 620 and upper spacer 610 are disassembled, the dust screen 630 can be taken out and changed. When the dust screen 630 is contaminated by dust, the upper and lower spacers 610, 620 can be disassembled, it is more convenient to take out, change and clean the dust screen 630.

In some embodiments, for simple assembly and disassembly, the upper spacer 610 and lower spacer 620 can be connected in the following way. The upper spacer 610 is provided with chucking interfaces 611, the lower spacer 620 is provided with n-shaped buckles 621 corresponding to the chucking interfaces 611. The upper end of an n-shaped buckle 621 protrudes upwards, so that it can be inserted in the chucking interface 651. One side of lower end of n-shaped buckle 621 is fixed to the lower spacer 620, the other side of lower end of n-shaped buckle 621 extends downwards, lower than the lower surface of lower spacer 620, forming a buckle 621 tripper 622 which can be moved by external force. The tripper 622 is shown in FIG. 6. The external surface of the upper end of the n-shaped buckle 621 on the side of buckle 621 tripper 622 is provided with a buckling tooth 623 for clamping the edge of chucking interface 611. An implementation method of clamping structure, when the buckle 621 tripper 622 is pressed by an external force, the clamping relationship can be cancelled easily, convenient for assembly and disassembly.

In some embodiment, two opposite sides of the upper spacer 610 are provided with a chucking interface 611 respectively, and the lower spacer 620 is provided with two opposite n-shaped buckles 621; one chucking interface 611 and one n-shaped buckle 621 are clamped as one clamping point: two cambered dust screens 630, distributed on both sides of the two clamping points. An implementation structure of dust screen 630, the dust screen 630 can be removed easily. In other embodiments, there can be more chucking interfaces 611 and n-shaped buckles 621, forming more clamping points. In this case, as there are more clamping points, there will be more obstructions in the dust screen 630, more dust screens 630 are required to form an integral dustproof structure, in some embodiments, the dust screen 630 can be mesh type dustproof holes. In the embodiment shown in FIGS. 8-9, the dustproof cotton is provided with small circular holes as dustproof holes, forming a dust screen 630. In other embodiments, the dust screen 630 can be other materials or structures.

In some embodiment, one side edge of connection between the chucking interface 611 and buckling tooth 623 comprises a convex side 612 and a concave side 613. The convex side 612 coordinates with buckling tooth 623 for restraint the concave side 613 facilitates turning to cancel the clamping relationship, it is convenient to engage and disengage the chucking interface 611 and n-shaped buckle 621.

In some embodiment, a mounting flange 614 extends vertically on the inner ring of the upper spacer 610; the inner ring of the lower spacer 620 is fitted over the lower lateral surface of mounting flange 614; the mounting flange 614 is provided with a connecting device for installing the motor mounting bracket 230. The mounting flange 614 further stabilizes the linkage structure of upper and lower spacers 610, 620; and it can be connected to the motor mounting bracket 230.

In some embodiment, the connecting device for installing the motor mounting bracket 230 is a connecting flange 6141 protruding on the medial surface of mounting flange 614. The connecting flange 6141 is provided with a threaded hole; a bulge extends upwards on the outer edge of connecting flange 6141, a connecting storage cavity 6142 is formed on the upper surface of connecting flange 6141. The connecting storage cavity 6142 forms the connection guiding relationship, facilitating placing the joint pin of the motor mounting bracket 230 in the connecting storage cavity 6142 of connecting flange 6141, the installation is more convenient. This is an implementation method of the connecting device for installing the motor mounting bracket 230. In other embodiments, it can be designed as other structures for installing the motor mounting bracket 230 or motor mounting elements of other structures.

The air inlet partition 600 is assembled in the open structure of body case 101, so a linkage structure is required between air inlet partition 600 and body case 101, the linkage structure can use screwed connection, bonding and muff coupling.

Specifically, in this embodiment, the lower spacer 620 is provided with upwards inverted L-shaped rotary clips 624, the upper spacer 610 is provided with punch holes 615 for the L-shaped rotary clips 624 to go through; the L-shaped rotary clip 624 passes through the punch hole 615 and engages with the groove in the inner wall of body case 101.

Figure 10:
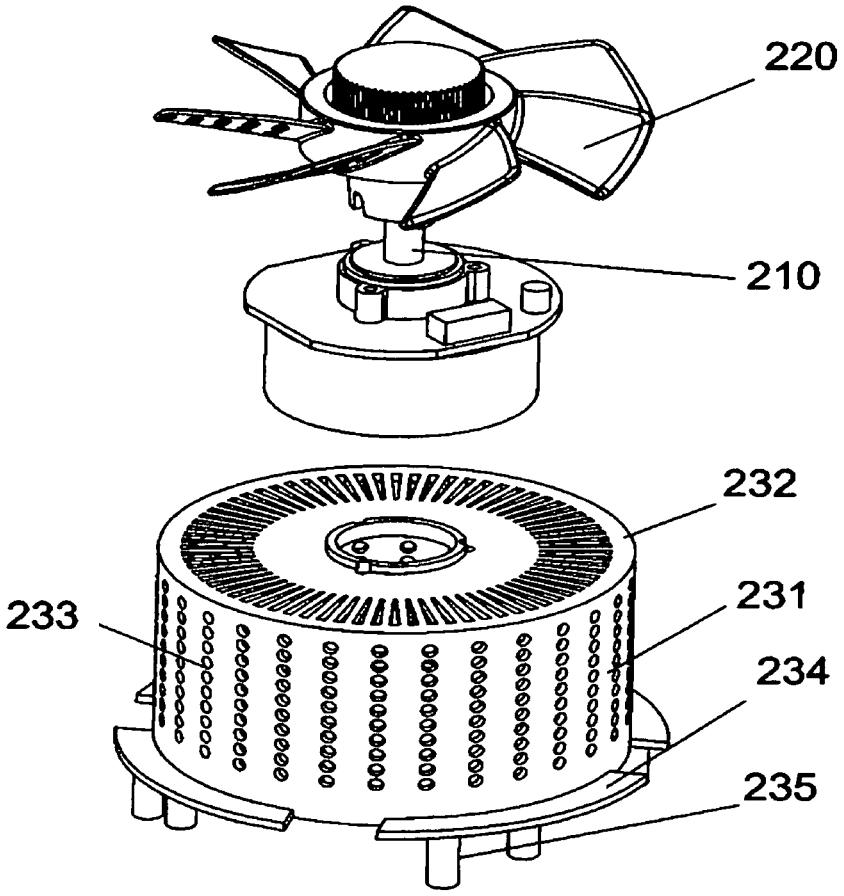
FIG. 10 is a structural representation of blast system in exploded state in the present invention.
Figure 11:
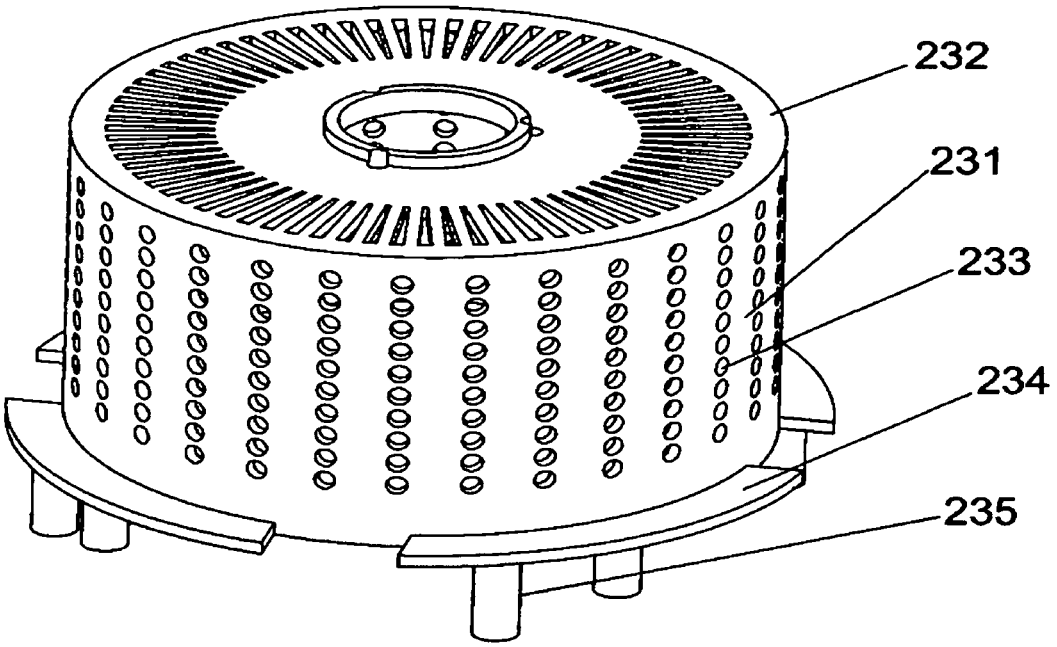
FIG. 11 is a structural representation of motor mounting bracket in the present invention.

As shown in FIGS. 10-11, the motor mounting bracket 230 comprises a cover 231, the inside of cover 231 is a hollow motor mounting position, the lower end face of cover 231 is an open structure which is convenient for assembling and disassembling motor 210, the motor 210 is assembled in the motor mounting position through the opening at the lower end of cover 231, the output shaft of motor 210 passes through the top of cover 231 and projects up.

Specifically, the top plate of the cover 231 is a motor mounting plate 232 for installing motor 210; during assembling, the motor 210 can be placed in the cover 231 through the bottom opening of cover 231, and the motor 210 is screwed on the motor mounting plate 232; it is inversely mounted in cover 231, the output shaft of motor 210 extends out of cover 231 from bottom to top through the mounting punch hole. The impeller 220 is mounted on the motor output shaft located outside the cover 231, so as to avoid the motor mounting frame being in the upward air passage of impeller 220, the air output of impeller 220 can be increased; meanwhile the cover 231 has a simple structure, the motor 210 is installed in the cover 231, the sound is already absorbed. In comparison to the vaneless fan of the existing technology in FIG. 1, when the impeller 220 is rotating to pump air, the noise of motor 210 is obstructed by the cover 231, and the motor 210 does not obstruct the airflow from the impeller 220 anymore, so that the air volume and air velocity of impeller are increased greatly.

The motor 210 is assembled in the cover 231, the sound insulation problem is solved, but the motor 210 generates heat when it is running, and the heat shall be diffused, so there are through heat dissipation holes 233 in tire sidewall and top of cover 231, the heat of motor 210 can be emitted through the heat dissipation holes 233, and the lower end of cover 231 is an open structure, convenient for heat emission. Particularly, the impeller 220 is located above cover 231, there are heat dissipation holes 233 in the motor mounting plate 232 and side face of cover 231. The impeller 220 has a suction on the air inside cover 231. The heat dissipation holes 233 in motor mounting plate 232 and side face of cover 231 coordinate with the open structure at the lower end of cover, the impeller 220 drives the air inside cover 231 to flow, there is favorable cooling effect on motor 210.

To assemble the motor mounting bracket 230, the motor 210 is assembled in the cover 231 first, and then the cover 231 is assembled on the air inlet partition 600, specifically, the lower end of cover 231 is assembled in the space formed by the mounting flange 614 of air inlet partition 600.

As shown in FIG. 11, the specific assembly structure is that there are multiple horizontal flanges 234 for connecting and supporting the air inlet partition 600 extended outwards around the lower end of the cover 231; there is a wire gap between two adjacent horizontal flanges 234, the power conductors enter the body 100 through the fan base, a part of wires is connected to the motor 210; and a part of wires can enter the body through the wire gaps to connect other electronic components. The lower surface of the horizontal flange 234 is provided with a first joint pin 235 for fixing the air inlet partition 600. The diameter of the horizontal flange 234 is smaller than the inner ring diameter of air inlet partition 600, i.e. smaller than the inside diameter of mounting flange 614. During assembling, the first joint pin 235 supports the connecting flange 6141. For further fixing, screws can be used after assembly. The screws are connected to the upper spacer 610 of air inlet partition 600, so the disassembly or assembly of upper spacer 610 and lower spacer 620 will not be influenced, and the change of dust screen 630 will not be influenced.

In some embodiment, in order to further fix the cover 231, the cover 231 can be provided with a linkage structure, e.g. buckles and so on.

In the embodiment, the cover 231 is removably connected to the air inlet partition 600. But in some embodiments, the lower end of the cover 231 can be integrated with the air inlet partition, meaning the cover 231 and air inlet partition 600 are formed conjointly, e.g. by injection molding and casting. When integral molding is used, it is connected only to the upper spacer 610 of air inlet partition 600, not to the lower spacer 620.

The cover 231 is fixed to the air inlet partition 600, to remove the air inlet partition 600, as the motor mounting bracket 230 is not connected to the other structures in the body 100, the motor mounting bracket 230, motor 210 and impeller 220 can be assembled or disassembled synchronously; easy assembly and disassembly, convenient for repair and dusting of motor mounting bracket 230, motor 210 and impeller 220, it is simple, convenient and fast.

After the air inlet partition 600 and blast system 200 are assembled in the way, the power is supplied and the body 100 is put in operation, the motor 210 drives the impeller 220 to rotate, the air is imported into the air inlet partition 600, driven by the impeller 200 and jetted out of the air outlet 102 of body case 101. During air intake, the dust screen 630 obstructs dust and large sweeps, guaranteeing the internal environment of body 100, so as to guarantee the quality of the jetted air. When the impeller 220 delivers air upwards, there is no motor mounting frame obstructing the airflow from the impeller, so that the output air volume and air velocity of Impeller can be increased greatly.

An important function index of a vaneless inverter fan is the sound-reducing effect, so a sound-reducing structure 500 is required in the body 100.

Step 1 of sound-reducing, a first sound-reducing cotton is attached to the inner wall of cover 231, the first sound-reducing cotton will not interfere in the heat dissipation holes in the cover 231, it is provided with holes matching the heat dissipation holes in the positions corresponding to heat dissipation holes.

A sound-reducing chamber is formed inside the sound-reducing structure 500, the blast system 200 is assembled in the sound-reducing chamber, or at least the impeller 220 of blast system 200 shall be assembled in the sound-reducing chamber.

Figure 12:
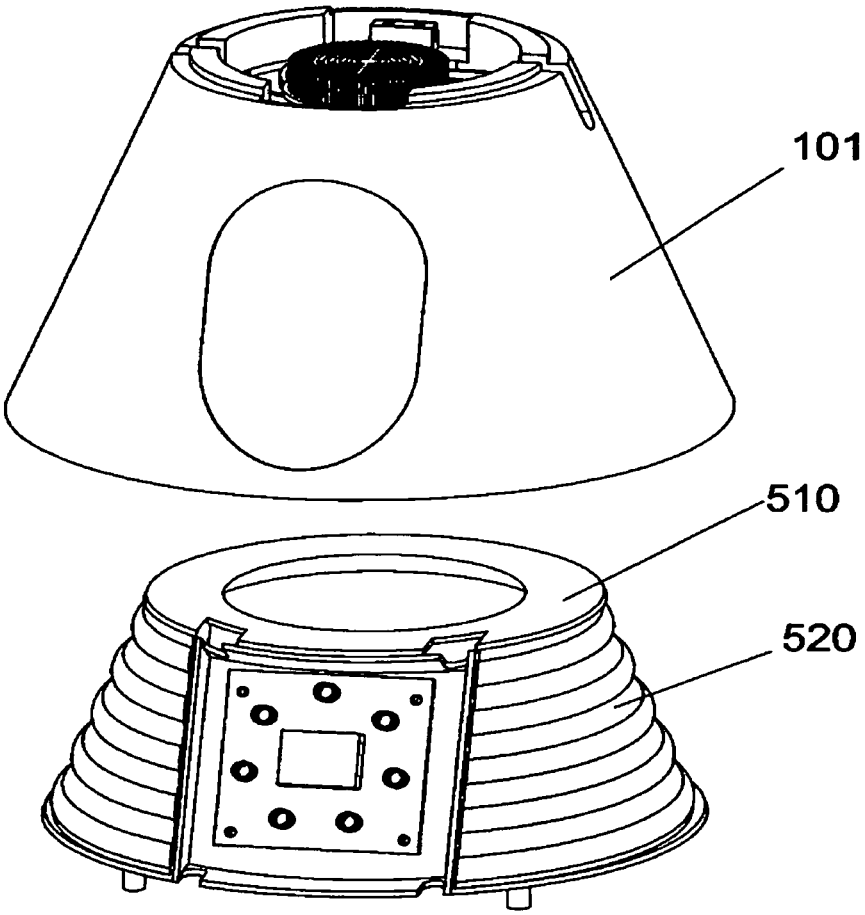
FIG. 12 is a structural representation of sound-reducing structure in combined state in the present invention.
Figure 13:
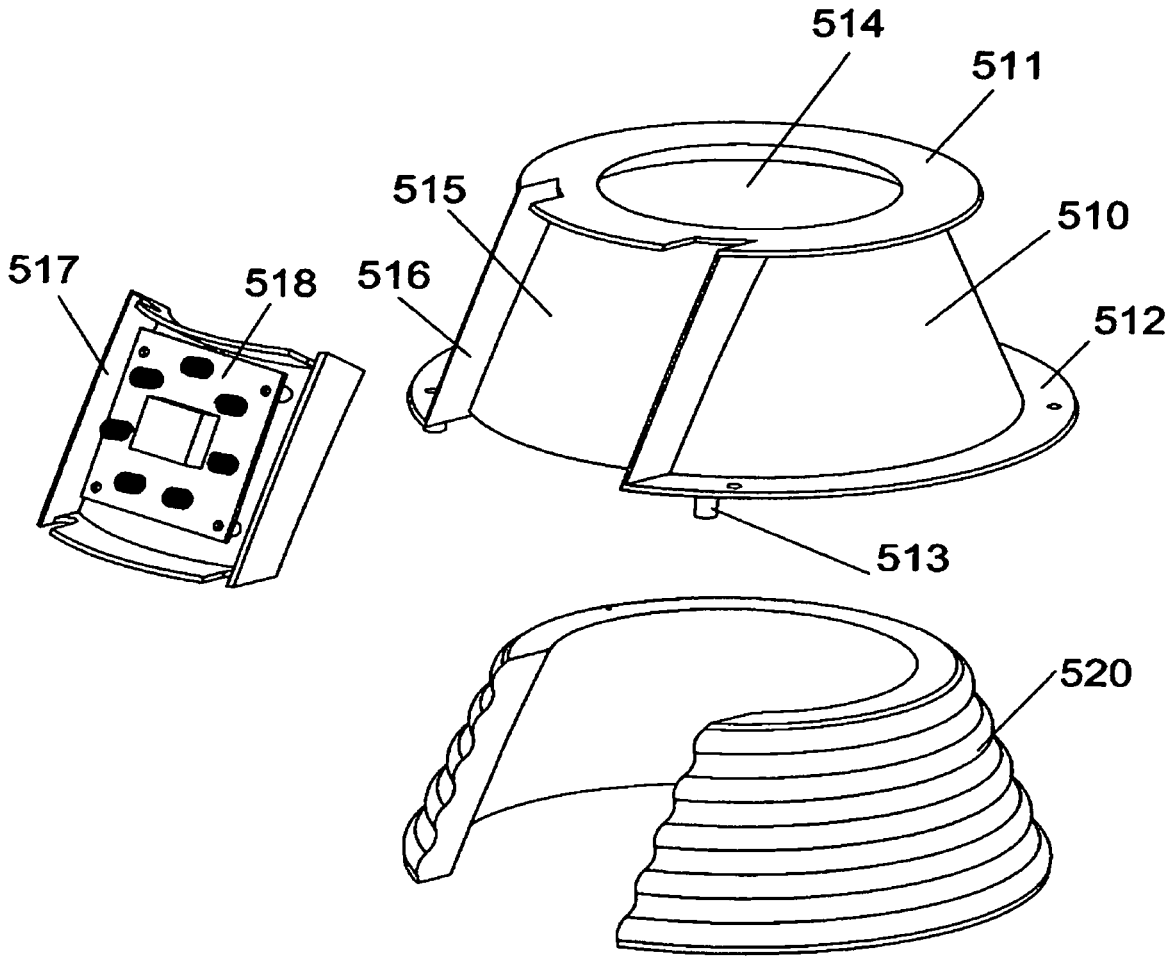
FIG. 13 is a structural representation of sound-reducing structure in exploded state in the present invention.
Figure 14:
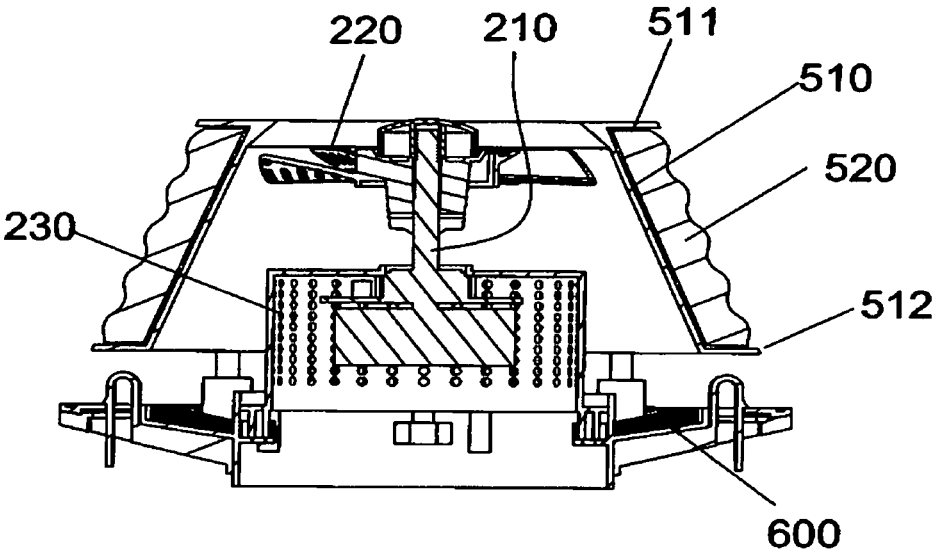
FIG. 14 is a sectional view of air inlet partition, blast system and sound-reducing structure in combined state in the present invention.
Figure 15:
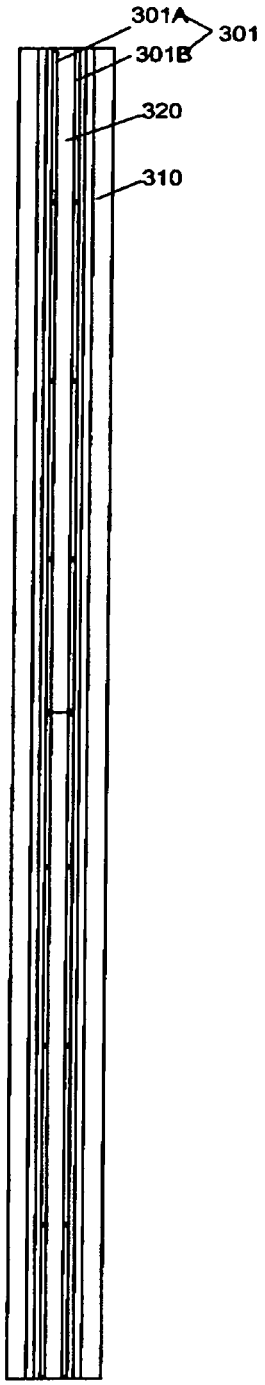
FIG. 15 is a structural representation of air supply column in the present invention.

As shown in FIGS. 12-14, the sound-reducing structure 500 comprises a truncated cone shaped sound-reducing mount 510, an annular top flange plate 511 protrudes outwards at the upper end of the sound-reducing mount 510, an annular bottom flange plate 512 protrudes outwards at the lower end of the sound-reducing mount 510; the second sound-reducing cotton 520 is mounted between the top flange plate 511 and bottom flange plate 512; the inside of the sound-reducing mount 510 is the impeller mounting space; the upper end of sound-reducing mount 510 is the mount air outlet 514 of sound-reducing mount 510, the diameter of mount air outlet 514 is less than or equal to the fanning diameter of impeller 220, aligned with the impeller under mount air outlet 514 to guide air.

The wind fanned by the impeller 220 is discrete to a degree, the farther from the impeller 220, the more transversely the wind beam diffuses; the fanning diameter of impeller 220 refers to the diameter of fanning vane; the impeller is located under the air outlet, the air outlet diameter is less than or equal to the fanning diameter of impeller 220, so as to cluster air, and the truncated cone shaped tilted inner side wall can guide the air, the wind energy loss is reduced as possible.

For the vaneless fan of this project, there is no motor mounting frame above the impeller 220, so the end diameter of upper mount air outlet 514 of sound-reducing mount 510 can be smaller than the fanning diameter of impeller 220, and the sound-reducing mount 510 is truncated cone shaped, the inner side wall has a gradient for guiding air; the sound-reducing mount 510 has an air guide function, reducing the wind energy loss in the course of air supply in the body 100.

The sound-reducing cotton 520 is also annularly truncated cone shaped, the medial surface of sound-reducing cotton 520 adheres to the sound-reducing mount 510; the lateral surface of sound-reducing cotton 520 is provided with several convex circumferential ripples. The convex circumferential ripples on the lateral surface better meet the reflection principle of sound wave under the annularly truncated cone shaped structure of sound-reducing cotton, the sound-reducing effect is stronger. Certainly, in this embodiment, the upper end of sound-reducing mount of sound-reducing mount 510 is higher than the impeller, and it is closed, so as to absorb sound wave to a degree.

The sound-reducing structure 500 is assembled in the body case 101. First of all, the overall formation of sound-reducing structure 500 is approximately identical with the inner chamber shape of body case 101, and the outer wall of sound-reducing structure 500, i.e. the outer wall of the second sound-reducing cotton 520, adheres to the inner wall of body case 101, the assembly space is saved as possible, and the volume of body case 101 is reduced.

To assemble the sound-reducing mount 510, tire top flange plate 511 can be fixed to the end wall of body case 101 by screws, or by buckling and binding.

To assemble the sound-reducing mount 510, the bottom flange plate 512 can be connected to the upper spacer 610 of air inlet partition 600. The sound-reducing mount 510 can be assembled by connecting other structures to the inner wall of body case 101 for stable assembly.

In this embodiment, the sound-reducing mount 510 is connected to the air inlet partition 600, it is convenient for assembly, disassembly and repair. The specific structure is that multiple joint pins 513 connected to the air inlet partition 600 are spaced evenly and circumferentially on the lower end face of bottom flange plate 512; the upper end face of the top flange plate 511 props the inner side of upper end of external body case 101; correspondingly, the upper spacer 610 of air inlet partition 600 is provided with lower joint pins 616 matching joint pins 513, which are fixed by screws.

The inner space of the sound-reducing mount 510 can hold the impeller 220 and motor 210 simultaneously. The sound-reducing element of the existing technology (FIG. 1) cannot be expanded vertically, it only silences the impeller, whereas the sound-reducing mount 510 of this application can be expanded vertically in the body case 101 to hold impeller 220 and motor 210 at the same time, it has better sound-reducing effect. As shown in FIG. 14, the lower end of sound-reducing mount 510 is not all under the motor 210, but in some embodiments, the linkage structure of sound-reducing mount 510 and air inlet partition 600 can be shortened, the lower end face of sound-reducing mount 510 is moved down, the motor 210 can be completely put in the sound-reducing mount 510, there is sound-reducing effect on overall impeller 220 and motor 210, the sound-reducing effect is stronger.

In the sound-reducing mount 510 of this embodiment, the inner side wall at the mount air outlet 514 is an inward tipping circular converging air guide structure from bottom to top. The inward tilt angle of the inner side wall of the mount air outlet 514 is larger than the inward tilt angle of lower inner side wall of sound-reducing mount 510. The mount air outlet 514 uses circular converging air guide structure, the tilt angle of inner side wall is larger than the tilt angle of lower inner side wall of sound-reducing mount 510, so that the sound-reducing mount 510 is higher than the upper end of impeller 220, the opening is closed fester, the volume of upper end of sound-reducing mount 510 is controlled. The body space utilization rate is increased, and the material consumption is reduced.

In some embodiments, there is a control circuit board mounting position 515 on the lateral surface of the sound-reducing mount 510 corresponding to the touch screen of body 100; the second sound-reducing cotton 520 is provided with a vacancy corresponding to the control circuit board mounting position 515.

In some embodiments, the lateral surface of the sound-reducing mount 510 is provided with a mounting baffle 516 corresponding to the right: and left sides of the control circuit board mounting position 515 respectively. The upper and lower ends of the mounting baffle 516 are connected to the top flange plate 511 and bottom flange plate 512 respectively. The mounting baffle 516 separates the control circuit board mounting position 515 from the sound-reducing cotton 520, and a fixed structure can be provided for fixing the control circuit hoard 518.

In some embodiments, the control circuit board 518 is fixed to the control circuit board mounting base 517, the control circuit board mounting base 517 is installed in the control circuit board mounting position 515. To install the control circuit board mounting base 517, the control circuit board 518 and control circuit board mounting base 517 can be fixed at first, and then the control circuit board mounting base 517 and mounting position 515 are assembled; the plane of reference for assembling control circuit board mounting base 517 and mounting position 515 can be predesigned, so that the installation of control circuit board is more convenient, stable and accurate.

There are wire gaps in mounting position 515 and mounting base 517 for wiring inside body 100.

The air supply column 300 is assembled at the air outlet 102 of body 100.

As shown in FIGS. 15-20, the air supply column 300 comprises an outlet tube 310 and an air guide component 320.

There is an opening connected to the inside of outlet tube in length direction of side of the outlet tube 310.

The air guide component 320 is laterally inserted in the opening of outlet tube 310, an air guide face 321 is formed on the air guide component 320; a narrow air supply slit 301 is formed between the tube wall at the opening of outlet tube 310 and the air guide face of air guide component 320.

Specifically, the outlet tube 310 has a C-shaped tube, bending and extending inwards along the opening of tube to form symmetrical side plates 311; the air guide component 320 is located between the two side plates 311 in the outlet tube 310; the air guide component 320 has an air deflector 322 corresponding to side plate 311, the narrow air supply slit 301 is formed between side plate 311 and air deflector 322; the air guide face 321 is formed on the air deflector 322, the airflow in the outlet tube 310 is guided by the air guide face 321 and jetted out of the narrow air supply slit 301; there are slots 302 in the inner wall of tube, the edges of air deflector 322 are inserted in the slots 302 to assemble the air guide component 320.

In terms of principle, the airflow in the outlet tube 310 can be emitted from the opening directly, but the diameter of opening is large, that will result in low air velocity, low air volume and dispersed airflow, as well as worse air supply effect. Therefore, the air guide component 320 reduces the opening diameter of outlet tube 310, so as to implement high air flow velocity, high flow, relatively concentrated airflow and ideal air supply effect.

Specifically, the side plate 311 comprises a first side plate 3111 and a second side plate 3112, the first side plate 3111 and second side plate 3112 are symmetrical, the first side plate 3111, second side plate 3112 and tube are formed integrally; the opening is formed between the first side plate 3111 and second side plate 3112.

In some embodiments, besides the C-shape, the tube of outlet tube 310 can be in other shapes, such as rectangle, ellipse and so on. However, according to the practical effect, the inner wall of C-shaped tube is cambered, which has minimum resistance/obstruction to the airflow, the airflow is influenced least, so the outlet tube 310 is C-shaped in this embodiment.

The air guide component 320 is installed at the opening, an air guide face 321 is formed on the air guide component 320, a narrow air supply slit 301 is formed between the air guide face 321 and the first side plate 3111 and second side plate 3112 respectively; the air guide face 321 of air guide component 320 guides the airflow out of the narrow air supply slit 301.

Specifically, the air deflector 322 comprises a first air deflector 323 and a second air deflector 324, one side of the first air deflector 323 is connected to one side of the second air deflector 324, the opposite sides extend oppositely, so that the first air deflector 323 and second air deflector 324 are approximately splayed, convenient for guiding the air.

A first narrow air supply slit 301A is formed between the first air deflector 323 and the first side plate 3111; and an air guide face is formed on the side of the first air deflector 323 corresponding to the first side plate 3111.

The second air deflector 324 corresponds to the second side plate 3112, a second narrow air supply slit 301B is formed between them, and an air guide face is formed on the side of the second air deflector 324 corresponding to the second side plate 3112.

Under the air guide effect of the first air deflector 323 and second air deflector 324, the air flows outwards in flaring pattern from the first air outlet 201A and second narrow air supply slit 301B.

Figure 16:
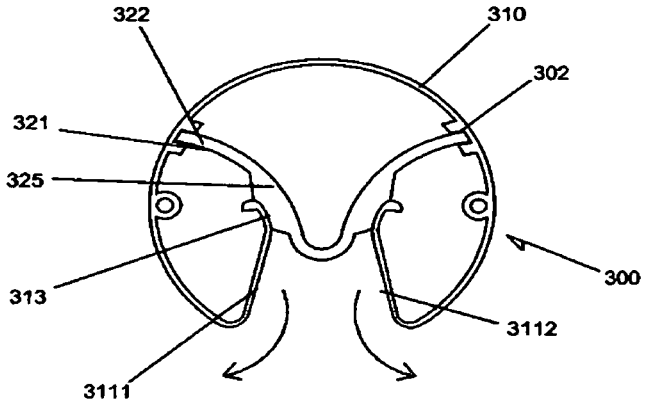
FIG. 16 is a structural representation of air supply column in top view in the present invention.
Figure 17:
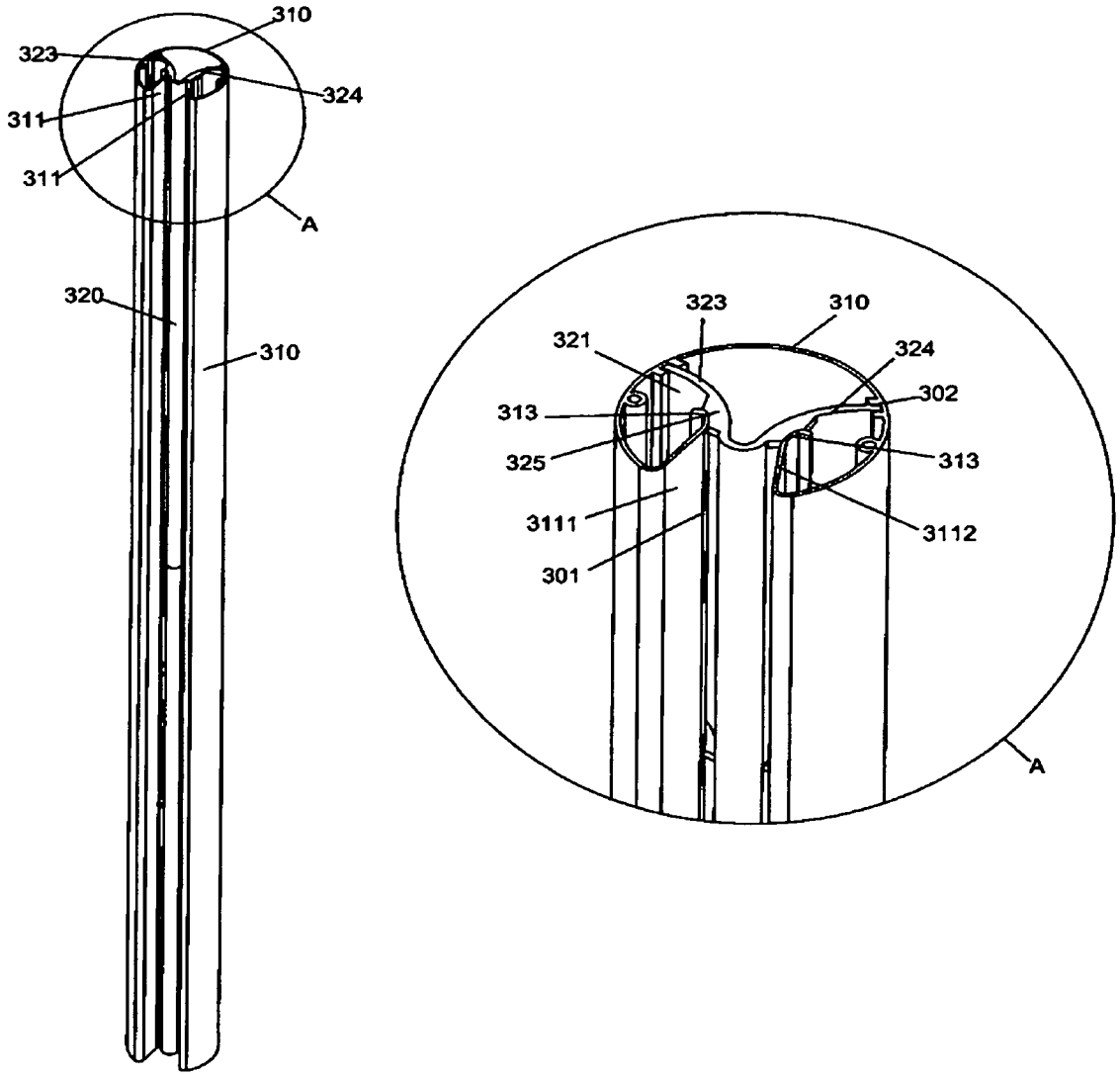
FIG. 17 is a structural representation of air supply column in axial direction in the present invention.
Figure 18:
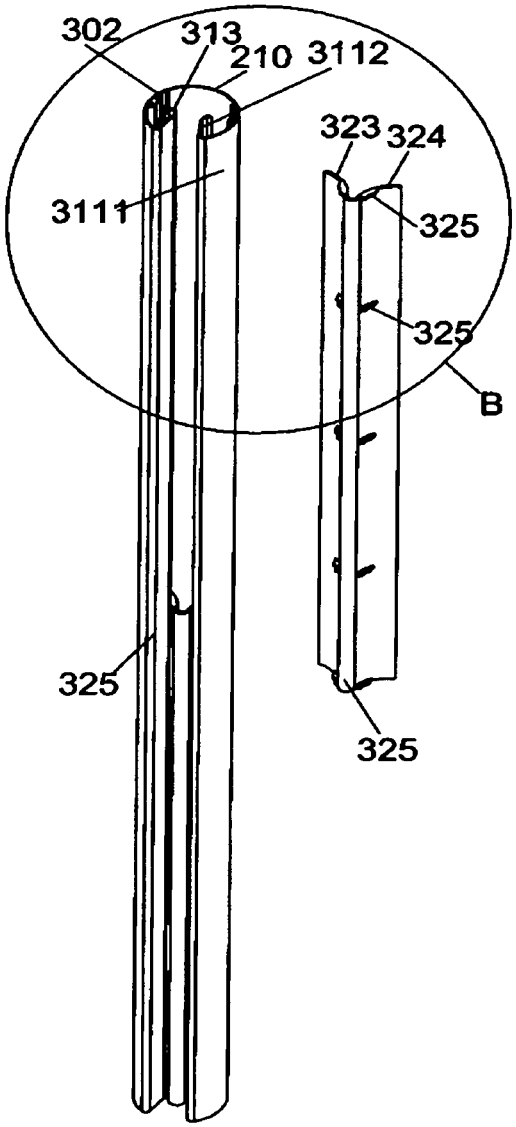
FIG. 18 is a close-up view of Part A in FIG. 17.
Figure 19:
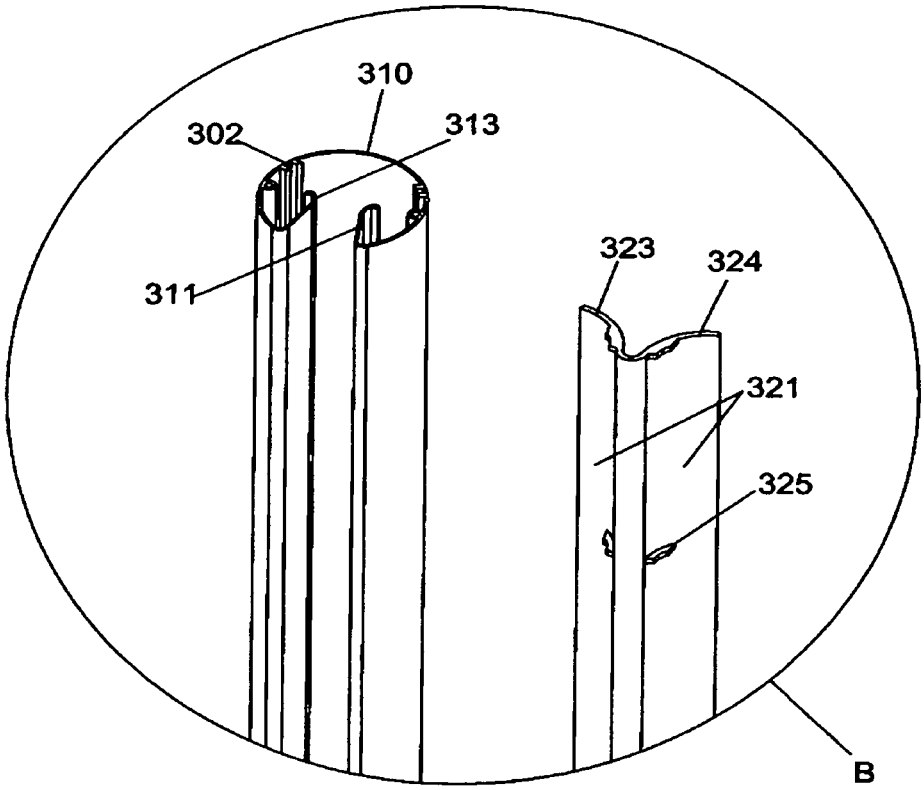
FIG. 19 is the structural representation of air supply column in exploded state in the present invention.
Figure 20:
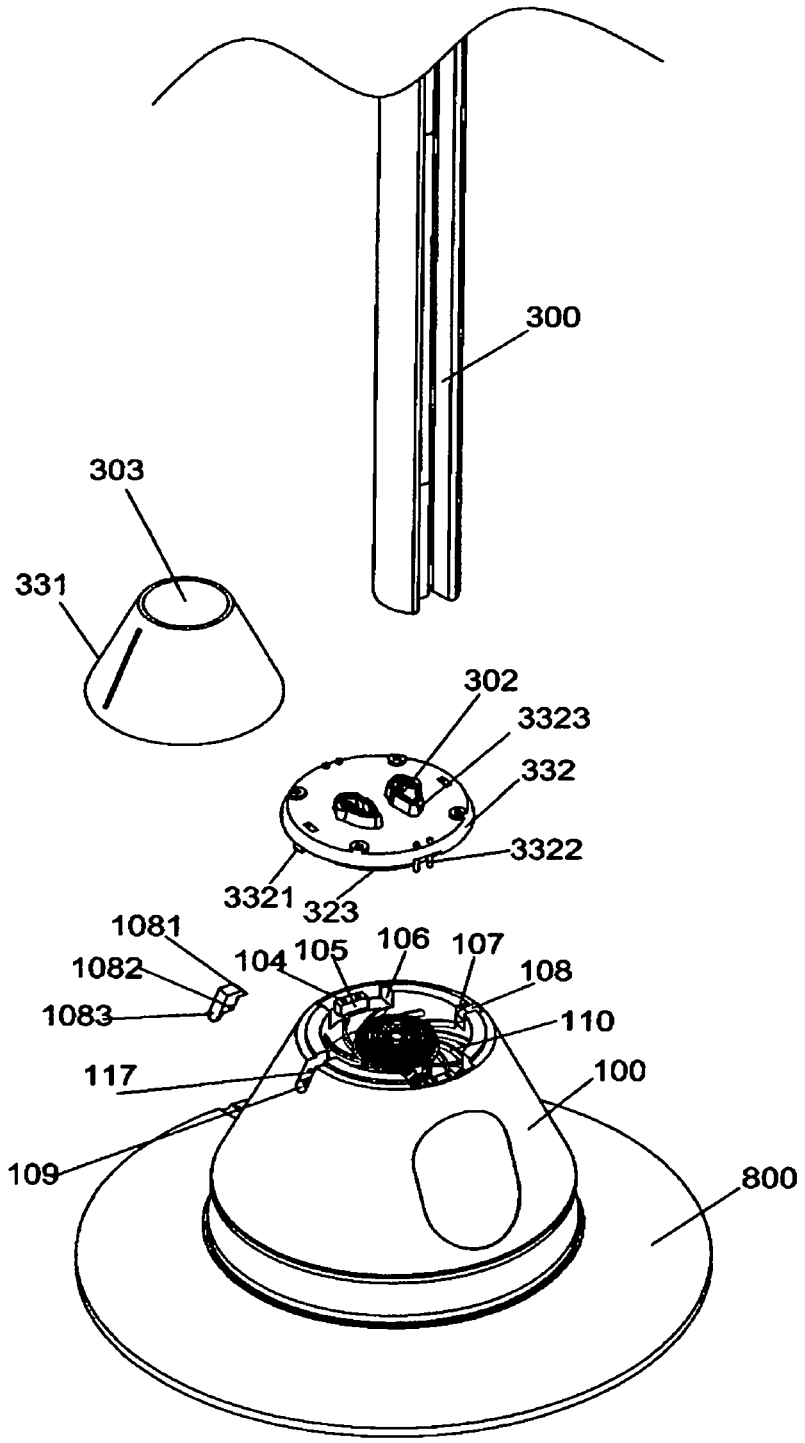
FIG. 20 is a close-up view of Part B in FIG. 19.

As shown in FIG. 16, the arrowhead indicates the direction of airflow from the first air outlet 201A and second narrow air supply slit 301B. The joint of the first air deflector 323 and second air deflector 324 is located in the opening of outlet tube 310 and protruding outwards (protruding far from the inside of outlet tube 310, i.e. downward bulge in the picture), the joint is not aligned with the first air outlet 201A and second narrow air supply slit 301B, so the airflows in the first air outlet 201A and second narrow air supply slit 301B are separated to some extent, so as to avoid the two flows colliding with/neutralizing each other.

The air guide component 320 is vertically assembled in the outlet tube 310, the second sides of the first air deflector 323 and second air deflector 324 are stuck in the grooves 214, there is interference between the first air deflector 323 and first side plate 3111 and between the second air deflector 324 and second side plate 3112, so as to prevent the air guide component 320 from escaping the outlet tube 310 in the horizontal direction.

The air outlet 201 comprises a first side plate 3111, a second side plate 3112 and a first air deflector 323 and a second air deflector 324 of an air guide component 320. In order to keep the stability of air outlet 201, a stable support structure Is located between the first side plate 3111 and first air deflector 323 and between the second side plate 3112 and second air deflector 324.

Specifically, the first side plate 3111 and second side plate 3112 extend inwards along the tube, one side is connected to main body 213, the opposite side is free, so the first side plate 3111 and second side plate 3112 can be deformed to a degree under an exogenic action.

A cambered bearing surface 313 is formed at the end of one side extended inward of the first side plate 3111 and second side plate 3112; the air guide component 320 is provided with multiple support bulges 325 corresponding to the cambered bearing surface 313, the support bulges 325 match the shape of cambered bearing surface 313. When the air guide component 320 is installed at the opening of outlet tube 310, there is an interaction force between support bulges 325 and cambered bearing surface 313, the first side plate 3111 and second side plate 3112 are deformed, so that the first side plate 3111 and second side plate 3112 have acting forces oriented to the first air deflector 323 and second air deflector 324 respectively, forming a stable connection.

The body 100 is connected to the air supply column 300 by a joint sleeve 330, the top of joint sleeve 330 is provided with a plug hole 303 for assembling the air supply column 300 and matching the shape of air supply column 300. The joint sleeve 330 is assembled at the top of body 100 and connected to the air outlet 102 of body 100. The air supply column 300 is connected to the air outlet 102 of body 100 by the joint sleeve 330.

There are positioning structure and buckle structure for stable connection between the end wall of body case 101 and the bottom of joint sleeve 330.

Figure 21:
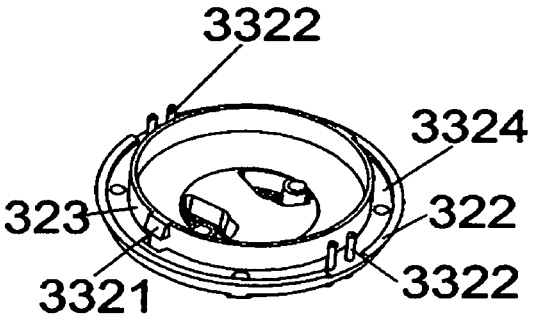
FIG. 21 is a structural representation of body, joint sleeve and air supply column in exploded state in the present invention.
Figure 22:
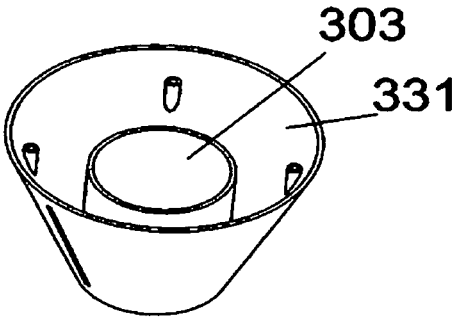
FIG. 22 is a structural representation of joint sleeve in exploded state in the present invention.

As shown in FIGS. 21-22, the end wall of body case 101 is provided with positioning lugs 105 with cylindrical slots 104, the positioning lug 105 is effective on positioning. The plug pins 3322 at the bottom of joint sleeve 330 corresponding to the cylindrical slots 104 guide the joint sleeve 330 to the top of body case 101 at a correct angle, so that the joint sleeve 330 can be installed on the top of body case 101 quickly.

In some implementation methods, a mounting slot 106 is provided downward in the end wall of body case 101, the positioning lug 105 is located in the mounting slot 106, the cylindrical slot 104 is provided downward in the end face of positioning lug 105.

In some implementation methods, there is a gap between the sidewall of positioning lug 105 and the slot wall of mounting slot 106.

A groove 107 is provided downward in the end wall of body case 101, an elastic buckle 108 is located in the groove 107. The top of joint sleeve 330 is provided with a buckle part 3321 matching the elastic buckle 108, the elastic buckle 108 and buckle part 3321 coordinate with each other to fix the joint sleeve 330 to the top of body case 101.

Specifically, the elastic buckle 108 coordinates with buckle part 3321, the elastic buckle 108 is assembled in the groove 107, in order to expose the elastic buckle 108 on the surface of body case 101, the groove 107 shall be connected to the lateral surface of body case 101. The elastic buckle 108 is connected to a return spring 109 for providing reset force for the elastic buckle 108. When the joint sleeve 330 is assembled on the body case 101, the elastic buckle 108 and buckle part 3321 hook each other, the return spring 109 provides strong clamping force between the elastic buckle 108 and buckle part 3321. When the elastic buckle 108 is turned, the elastic buckle 108 is separated from the buckle part 3321, the return spring 109 is compressed, the joint sleeve 330 can be taken out directly, and the air supply column 300 is taken out at the same time.

In some implementation methods, the elastic buckle 108 comprises a hook part 1081 for fastening the buckle part 3321 at the bottom of joint sleeve 330, a pivot shaft 1082 pivoted in the groove 107 and a main body 1083 for pushing the elastic buckle 108 to revolve round the pivot shaft 1082 in the groove 107. One end of return spring 109 is connected to the elastic buckle 108. the other end is connected to the inner wall of groove 107. The hook part 1081 is located at the top of elastic buckle 108.

A hole matching the pivot shaft 1082 is formed in the groove 107.

FIG. 22 is the structural representation of joint sleeve 330. The joint sleeve 330 can be separate, the joint sleeve 330 comprises a sleeve body 331 and a junction board 332. The sleeve body 331 and joint sleeve 330 are tightened by screws.

The sleeve body 331 is provided with the plug hole 303 for mounting the air supply column 300, the junction board 332 is provided with a through hole 302 penetrating the upper and lower surfaces of junction board 332. The air supply column 300 is connected to the air outlet 102 of body 100 by the through hole 302.

The bottom of junction board 332 is provided with the plug pins 3322 corresponding to the cylindrical slots 104; a flange ring 323 extends downward from the bottom of junction board 332, the flange ring 323 is inserted in the air outlet 102 at the top of body case 101, adhering to the inner wall of air outlet 102; the buckle part 3321 is formed on the circumference of flange ring 323.

During assembling, the plug pins 3322 are inserted in the cylindrical slots 104, guiding the joint sleeve 330 to the top of body case 101 correctly. While the plug pins 3322 are being inserted in the cylindrical slots 104, the buckle part 3321 contacts the hook part 1081 of elastic buckle 108, the elastic buckle is opened by the interaction force, the return spring 109 is compressed. When the plug pins 3322 are completely inserted in the cylindrical slots 104, the buckle part 3321 enters the groove 107, and the interaction force between buckle part 3321 and hook part 1081 disappears, the elastic buckle 108 is resulted under the acting force of return spring 109, the buckle part 3321 is restrained in the groove 107.

In the assembling process, the buckle part 3321 and elastic buckle 108 contact and move each other, there shall be a guide face between them to guide installation.

For disassembly, the elastic buckle 108 is pushed, the hook part 1081 of elastic buckle 108 is disengaged from the buckle part 3321, and the joint sleeve 330 is moved up to take out the joint sleeve 330, so that the air supply column 300 is separated from the body 100.

In this embodiment, the positioning lugs 105 are symmetrically located on the end wall of body case 101, and the elastic buckles 108 are symmetrically located on the body case 101, correspondingly, the plug pins 3322 and buckle parts 3321 are symmetrically located on the junction board 332.

In some implementation methods, the number of positioning lugs 105 and elastic buckles 108 can be changed according to the size of body 100.

In order to assemble the joint sleeve 330 on the top of body case 101 more stably, an inner flange 110 is formed on the end wall of body case 101, so that the end wall of body case 101 is steplike, a slot 3324 is formed in the bottom of junction board 332 corresponding to the inner flange 110 on the end wall of body case 101, the assembly is steadier.

In some implementation methods, as shown in FIG. 3, a flange 3323 is formed upwards on the end face of junction board 332 corresponding to the through hole 302.

In some implementation methods, the air supply column 300 is inserted in the plug hole 303 of joint sleeve 330, the end of air supply column 300 contacts the junction board 332, and they are locked by screws.

In some implementation methods, the air supply column 300 and joint sleeve 330 can be connected by buckling, locking and clamping.

As shown in FIG. 16, the air guide component 320 divides the inside of outlet tube 310 into three regions, the regions on both sides correspond to the narrow air supply slits 301A, 301B respectively. The regions on both sides exactly correspond to the through hole 302 in the junction board 332, and the flange 3323 is stuck in the two regions, further stabilizing the connection.

Figure 23:
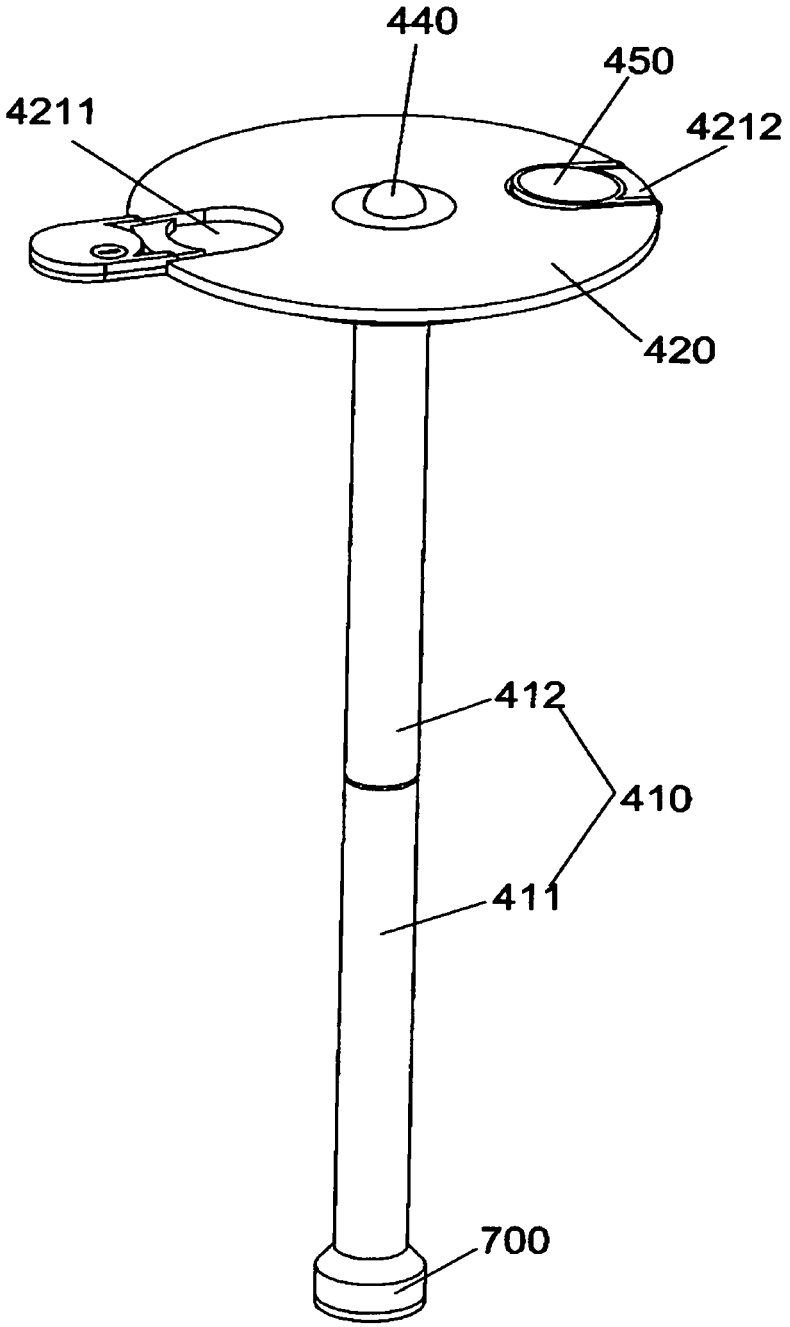
FIG. 23 is a structural representation of lighting device in the present invention.

As shown in FIG. 23, the air outlet 102 at the upper air outlet end of body case 101 of this application is provided with an air outlet spacer plate 120. The air outlet spacer plate 120 is a grille plate, it is a spiral grille plate in this application. The outer side of air outlet spacer plate 120 is fixed to the sidewall of air outlet. A PTC warmer 130 is placed above the air outlet spacer plate 120. The upper and lower surfaces of PTC warmer 130 can be provided with multiple through holes for air flow and heat exchange. The air outlet spacer plate 120 supports the PTC warmer 130, and the PTC wanner 130 enables the fan of this application to deliver hot air to regulate the external temperature and humidity; and to deliver airflow at normal temperature, providing diversified functions.

The structure of vaneless fan of this project is stated above, to further increase the functions, the basic structure is provided with a lighting device 400.

Figure 24:
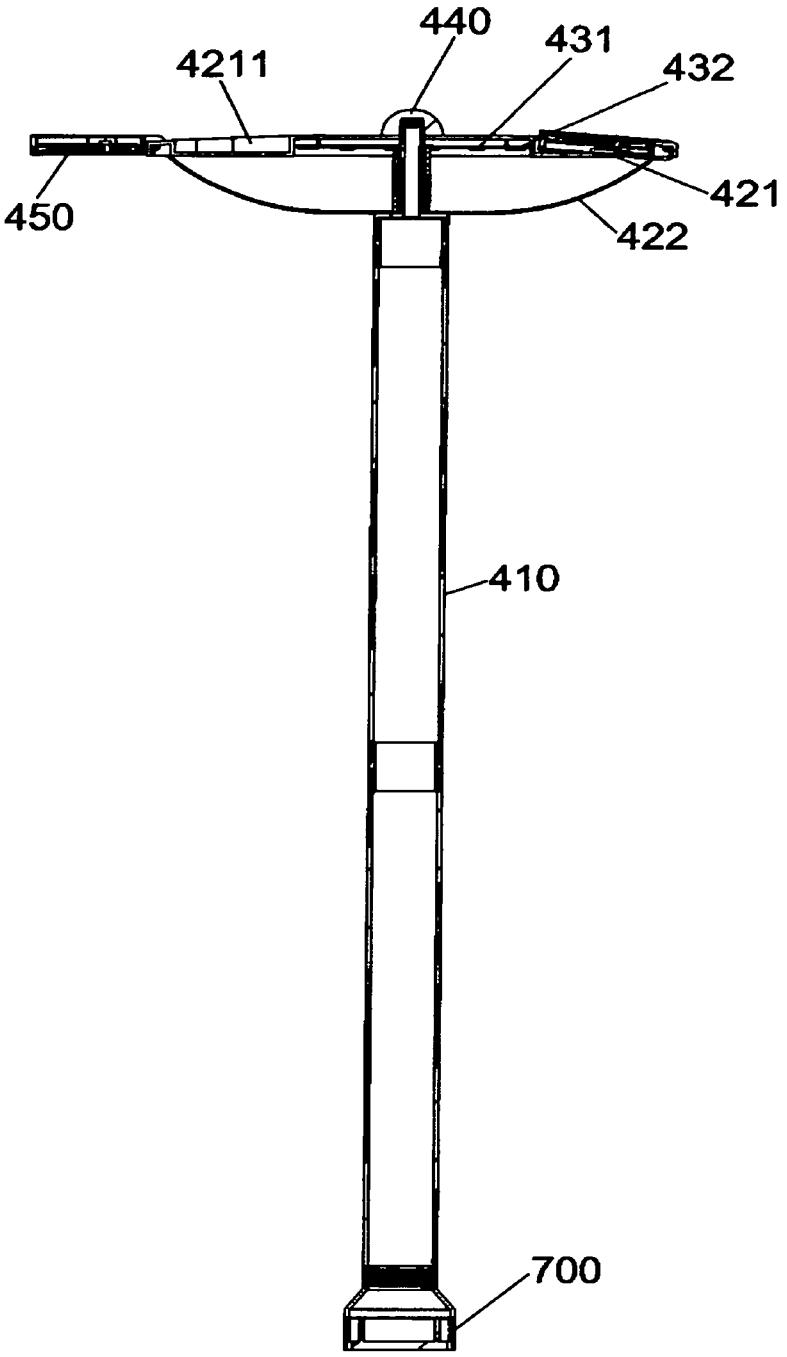
FIG. 24 is a structural representation of section of lighting device in the present invention.
Figure 25:
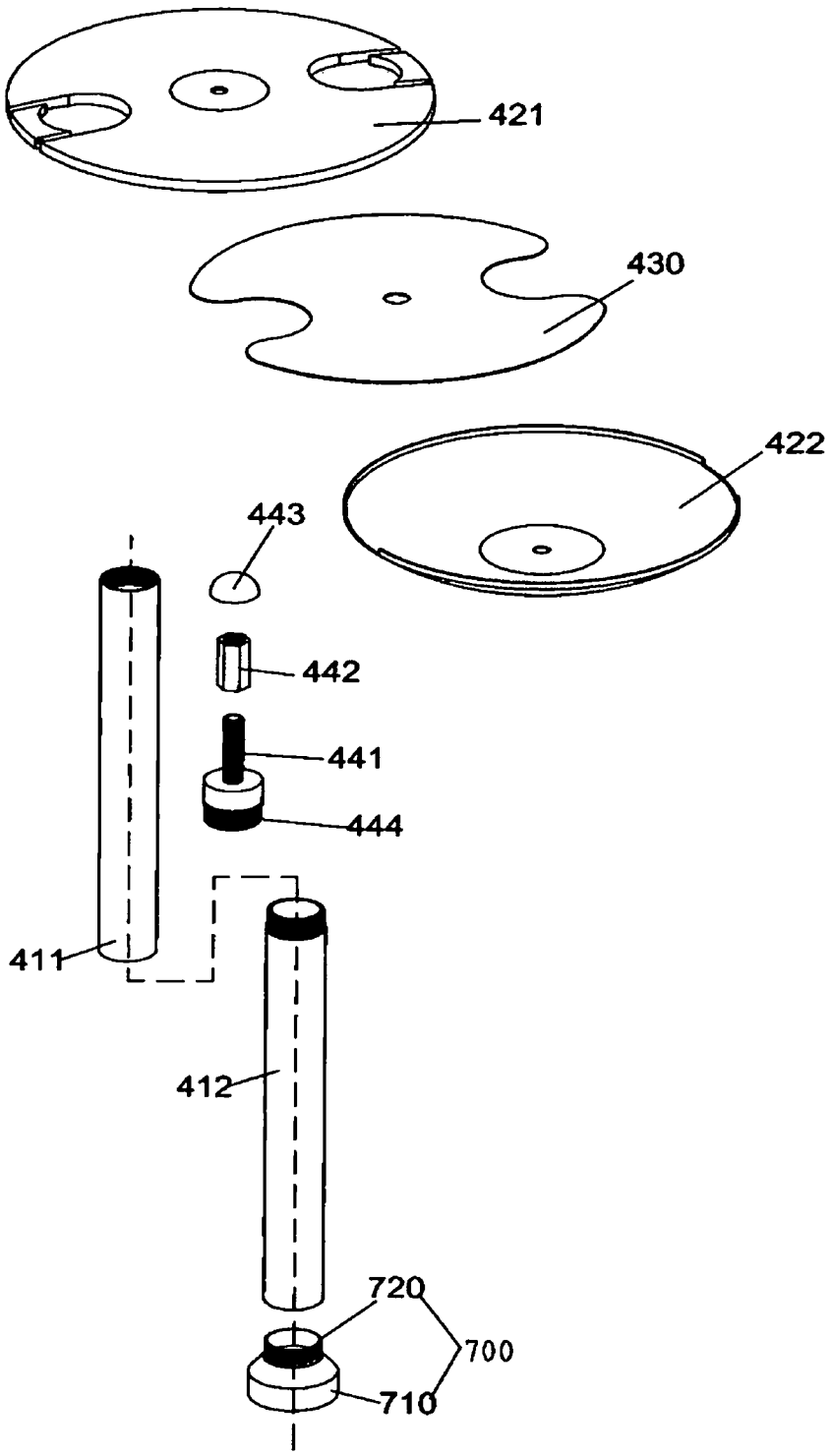
FIG. 25 is a structural representation of lighting device in exploded state in the present invention.

As shown in FIGS. 23-25, the lighting device 400 comprises a lamp tube 410, a lamp housing 420 and a luminous element 430. The light rays of luminous element 430 are diffused by the lamp housing 420, so as to implement the lighting function of vaneless fan.

The lamp tube 410 is installed on the top of air supply column 300 of vaneless fan, aligned with the air supply column 300. The lamp tube 410 and air supply column 300 can be made of the same or different materials. The lamp tube 410 is a hollow straight tube. There is a connector 700 between the lamp tube 410 and air supply column 300. The connector 700 can be a threaded joint, the lamp tube 410 and air supply column 300 are connected by thread, this connection mode is very simple, convenient for assembly.

Specifically, the connector 700 comprises a tapered boss 710 and a screwed ring 720 formed above the tapered boss 710. The screwed ring 720 is fastened to the end of lamp tube 410.

In some implementation methods, the tapered boss 710 is provided with internal thread, and the top of air supply column 300 is provided with external thread, and the air supply column 300 is screwed on the connector 700, so as to implement quick connection between lamp tube 410 and air supply column 300.

In some implementation methods, besides the threaded connection, the connector can use screws for connection. There are screw holes in the tapered boss 710, so that it can be fixed to the air supply column 300 by screws. The tapered boss 710 implements stable connection between the lamp tube 410 and air supply column 300.

In some implementation methods, the lamp tube 410 can be piecewise straight tube structure. The lamp tube 410 comprises a first subsection 411 and a second subsection 412. The first subsection 411 and second subsection 412 are connected sequentially, the connection mode can be but not limited to simple threaded connection, a rotary buckle is workable. The piecewise structure of lamp tube 410 facilitates transportation, multiple subsections are allowed for delivery, and the user can assemble the lamp tube 410 according to actual requirement, the rest of subsections can be kept as spare parts.

In some implementation methods, the diameter of lamp tube 410 shall be equal to or a little smaller than the diameter of air supply column 300. However, the diameter of lamp tube 410 shall not be larger than the diameter of air supply column 300, a structure wide at top and narrow at bottom may influence the overall stability of vaneless fan after assembly.

The lamp housing 420 comprises a first case 421 and a second case 422 connected to each other. The first case 421 and second case 422 are assembled to form a storage chamber for holding the luminous element 430. The luminous element 430 is assembled in the storage chamber, the light rays are diffused through the lamp housing 420.

The first case 421 and second case 422 are assembled vertically, they can be connected by clamping or screws, or other connection modes, as long as the two cases can be connected up.

In the form of vertical assembling structure, the first case 421 is located above the second case 422, they are vertically clamped. The light rays of luminous element 430 are diffused outwards through the lamp housing 420. One or both of the first case 421 and second case 422 can be transparent covers, here the second case 422 is selected as a transparent cover structure, so that the light rays can be diffused outwards.

In some implementation methods, a part of the first case 421 and second case 422 is transparent cover structure, so that the light rays of luminous element 430 can be diffused outwards through the transparent cover.

In some implementation methods, there may not be a transparent cover above the lamp housing 420, the luminous element 430 is assembled in the lamp housing 420, and the LED light beads 432 of luminous element 430 are directly exposed outside the lamp housing 420, the light rays are emitted outwards directly.

In some implementation methods, there may not be a transparent cover above the lamp housing 420, the first case 421 and second case 422 are supported by transparent material directly, the light rays of luminous element 430 are diffused through the first case 421 and second case 422.

The luminous element 430 is a LED lamp panel. The LED lamp panel comprises a substrate 431 and LED light heads 432 installed on substrate 431.

The substrate 431 is fixed into the storage chamber, the LED light beads 432 are configured on substrate 431 corresponding to the second case 422, facilitating the diffusion of light rays through the second case 422.

In some implementation methods, the substrate 431 can be supported by the convex pins formed in the first case 421, the convex pins are provided with screw holes, the substrate 431 is fastened to the screw holes by screws, the assembly of substrate 431 is completed.

The luminous element 430 can be driven by the independent circuit module mounted in the lamp housing 420, the same as the control circuit of LED lamps of general structure, the circuit module comprises a driving circuit board, a power supply and a control switch. The luminous element 430 is electrically connected to the driving circuit board, the power supply provides electric energy for the luminous element 430.

The circuit module (not shown in the picture) is installed in the lamp housing 420, between the luminous element 430 and the first case 421. The power supply can be a storage battery, the storage battery supplies electric energy, so the driving circuit board shall be provided with a battery charging interface, the interface is exposed outside the lamp housing 420; or the power supply shall be directly connected to the grid, as long as the luminous element 430 is supplied with power.

The control switch can be a mechanical switch or a touch switch, the control switch controls the on/off of luminous element 430.

In some embodiments, the luminous element 430 can be connected to the circuit module 900 in the body 100 of vaneless fan, the circuit module in the body 100 of vaneless fan supplies electricity to the luminous element 430. As the lamp tube 410 is hollow, it is convenient for wiring.

The driving circuit or driving principle of luminous element 430 in this embodiment is of the existing technology or using the existing technology, the specific principle is not to be described in detail.

As shown in FIG. 25, the lamp housing 420 is removably installed on the top of lamp tube 410, the lamp housing 420 is installed on the top of lamp post 10 by a boss assembly 440.

The boss assembly 440 comprises a boss 441, a hexagonal nut 442 and a nut cap 443. A threaded mounting block 444 is formed at the lower end of boss 441. The top of lamp tube 410 is provided with internal thread. The mounting block 444 is screwed on the top of lamp tube 410.

The first case 421, second case 422 and substrate 431 are provided with concentric punch holes. The second case 422 is assembled first, the boss 441 passes through the punch hole of the second case 422, the bottom of the second case 422 supports the top of mounting block 444 or lamp tube 410; and then the hexagonal nut 442 is screwed on the boss 441, so as to limit the second case 422. Afterwards, the substrate 431 and the first case 421 are installed on boss 441, the substrate 431 contacts the top of hexagonal nut 442. Finally, the nut cap 443 is screwed on the boss 441 through the external thread of the first case 421, the assembly is completed.

In the assembly method, the substrate 431 can be assembled on the first case 421 by screws beforehand, certainly, the substrate 431 can be disconnected from the second case 422, the substrate 431 is limited by the boss assembly 440 directly.

In the assembly method, the height of boss 441 must be larger than the overall height of lamp housing, so that the assembled boss 441 can extend upwards through the punch hole of the first case 421 to be locked by the nut cap 443.

In the assembly method, after assembly, the first case 421 and second case 422 can be assembled by screws or clamping.

The illuminating lamp of the structure can be installed on the air supply column 300 of vaneless fan easily and quickly, facilitating transportation and assembly. It is assembled in the vaneless fan to implement lobby, corridor and indoor lighting while implementing cooling by ventilation/fanning.

In some embodiments, the lighting device 400 can be provided with a LED lamp 450, the LED lamp 450 can be used as a reading light.

As shown in FIG. 24, the LED lamp 450 is rotatablely assembled on the lamp housing 420.

The lamp housing 420 has a first case 421 and a second case 422 which are vertically combined, the end face of the first case 421 is provided with a storage tank 4211. The storage tank 4211 stores the LED lamp 450 when it is not used.

The LED lamp 450 is rotatablely assembled on the lamp housing 420 and corresponding to the storage tank 4211.

The LED lamp 450 is screwed in the storage tank 4211 for storage or screwed out of the storage tank 4211 for lighting.

Figure 26:
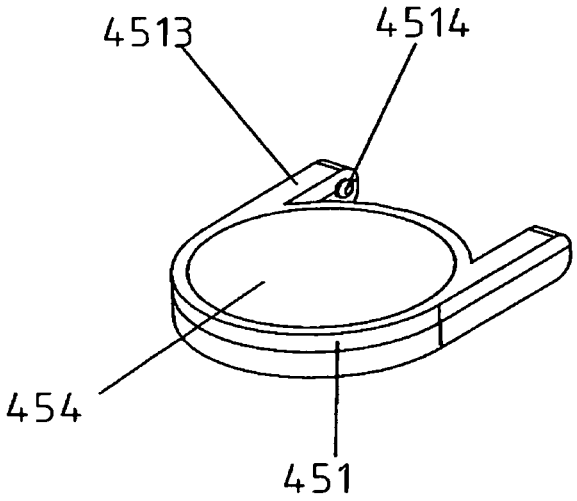
FIG. 26 is a structural representation of LED lamp in the present invention.
Figure 27:
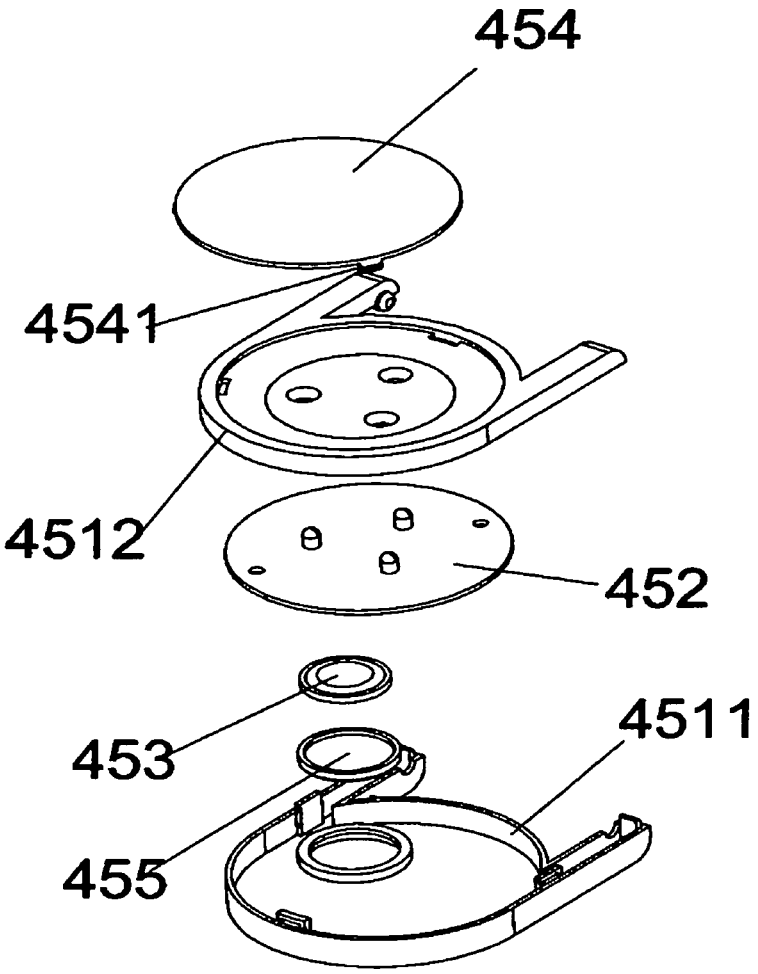
FIG. 27 is a structural representation of LED lamp in exploded state in the present invention.

The LED lamp 450 is reversibly assembled on the lamp housing 420. As shown in FIGS. 26-27, the LED lamp 450 comprises an outer casing 451, a lamp panel 452, a cell 453 and a switch (not shown in the picture, but the switch structure exposed outside the outer casing 451 is a conventional structure, as long as there is a hole for the switch in relevant position).

The outer casing 451 comprises an upper case 4511 and a lower case 4512 which are assembled vertically, the upper case 4511 and lower case 4512 are assembled to form an assembly space for the lamp panel 452. After the lamp panel 452 is assembled, the light rays of LED light beads on the lamp panel 452 are diffused through the lower case 4512. As shown in FIG. 27, there are catching grooves in the edge of upper case 4511, correspondingly, there shall be clasps at the edge of lower case 4512, the clasps are not shown in FIG. 7 due to angle problem, according to the cognition of the technical personnel of this field, this buckling connection principle is supposed to be understood.

Specifically, a pair of symmetrical pivot pins 4513 is formed on the outer casing 451, a pivot shaft 4514 pivoted on the storage tank 4211 is formed in a pivot pin 4513, correspondingly, the inner side wall of storage tank 4211 is provided with pivot holes, the LED lamp 450 can be turned upright.

The lower case 4512 has holes for exposing the LED light beads, the LED light beads come out of the holes in the lower case 4512 after the lamp panel 452 is assembled. A light-passing board 454 is provided on the surface of lower case 4512. The light-passing board 454 and lower case 4512 are connected by clamping.

The surface of lower case 4512 is provided with catching grooves, and the edge of light-passing board 454 is provided with catching pins.

The light-passing board 454 is even with the surface of lower case 4512 after assembly, so that the LED lamp 450 looks better.

The cell 453 is a button cell, the upper case 4511 has an opening for changing cell 453. There is a cell cover 455 at the opening for changing cell 453.

The switch 64 is electrically connected to the lamp panel 452, the switch 64 can be a mechanical switch or a touch switch.

Specifically, the storage tank 4211 is provided with a stopper 4212, a space for storing pivot pins 4513 is formed between stopper 4212 and right and left side walls of storage tank 4211.

As shown in FIG. 24, the lamp housing 420 is provided with two LED lamps 450, which are LED lamp 450A and LED lamp 450B, the LED lamp 450A is turned outwards to leave the storage tank 4211, the LED lamp 450B is stored in the storage tank 4211.

After use, the LED lamp 450 shall be stored in storage tank 4211 as LED lamp 450B, the light-passing board 454 is oriented upwards, if the LED lamp is turned on, the light goes up.

When in use, the LED lamp 450 shall be turned out of the storage tank 4211 as LED lamp 450A, the light-passing board 454 is oriented downward, if the LED lamp is turned on, the light goes down.

As stated above, the illumination angle can be regulated within 180°.

When the cell 453 is exhausted, the cell cover 455 can be opened to change the button cell.

In some implementation methods, the design of cell 453 can be cancelled, the independent circuit module in the lamp housing 420 can be powered via power cords.

In some implementation methods, the LED lamp 450 can be stored by horizontal rotation, the structure and size of storage tank 4211 shall be changed accordingly.

The LED lamp 450 can perform emergency lighting when the power is off, or supplement lighting when the light intensity of the luminous element 430 in the lamp housing 420 is insufficient.

In the structure, the lighting device 400 can be used for lighting, and it can emit light during air supply, it has extensive use and multiple functions.

As shown in FIG. 3, in order to further stabilize the body 100 of vaneless inverter fan on a plane/ground, a base 800 is provided under the body 100.

Figure 28:
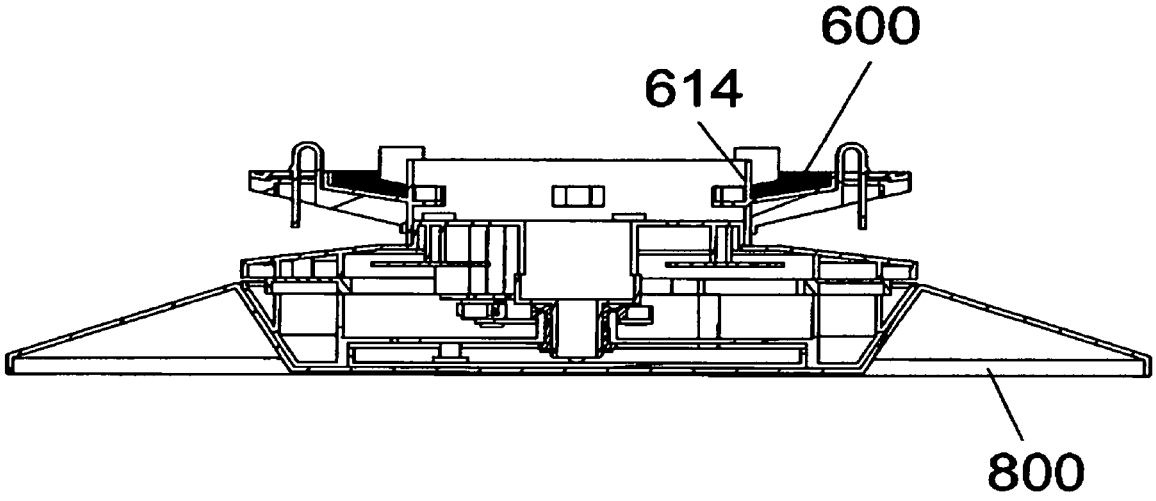
FIG. 28 is a structural representation of section of base in the present invention.
Figure 29:
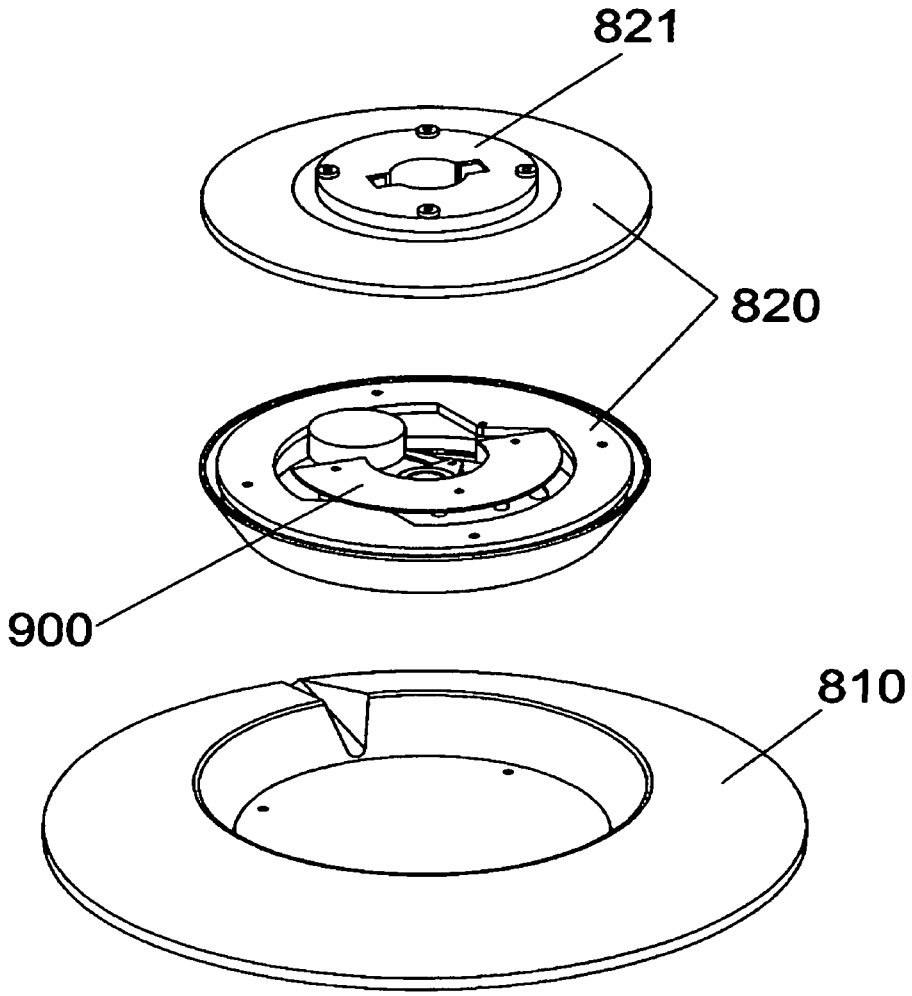
FIG. 29 is a structural representation of base in exploded state in the present invention.

As shown in FIGS. 28-29, the base 800 comprises a foundation support 810 and a brace table 820 assembled on the foundation support 810. The foundation support 810 is stably connected to the brace table 820. The specific stable connection mode is screwed connection, in some implementation methods, they can be connected by buckling and muff coupling.

The foundation support 810 is a dished structure, with a horizontal bottom surface, so that the complete machine can be placed on the ground/horizontal plane stably. The foundation support 810 thins from the center to edge.

The brace table 820 is designed for stable connection with body 100. The brace table 820 has an upper case and a lower case which are combined vertically. The cases form a storage chamber. The circuit module 900 is mounted in the storage chamber. The circuit module 900 controls the operation of body 100. The specific circuit theory of circuit module 900 varies with the practical requirement. This patent application mainly protects the hardware structure of vaneless inverter fan, not limits the circuit structure.

The end face of brace table 820 is provided with a circular boss 821. The circular boss 821 is identical with the shape of mounting flange 614 on the inner ring of upper spacer 610, and the mounting flange 614 can extactly cover the outer edge of circular boss 821, which are fixed by screws.

For convenient turning of body 100 of vaneless inverter fan to implement yawing function, the base 800 can be provided with a yawing motor. In the embodiment of FIG. 28, the brace table 820 has a mounting position for the yawing motor. In practice, the circular boss 821 can be rotatablely connected to the brace table 820, so that the circular boss 821 is driven by the yawing motor, and the body 100 is driven to turn, implementing the yawing function of air supply column 300.

I claim:

1. A vertical lighting vaneless inverter fan, comprising:

a body, including a body case, a blast system disposed in the body case; an air outlet formed on a top of the body case;

an air inlet formed below the air outlet of the body case; wherein the blast system includes a motor and an impeller driven by the motor, the motor is fixed in the body case through a motor mounting bracket, and the impeller is located above the motor and directly transmits wind to the air outlet;

an air supply column, which is a straight tube and disposed at a top of the air outlet of the body case to directly deliver wind outward;

a lighting device, including a lamp post and an illuminating lamp disposed on a top of the lamp post; wherein the lamp post is in a straight pipe and is disposed at a top of the air supply column to linearly connect with the air supply column; the light of the illuminating lamp is emitted to the surroundings;

wherein a bottom of the body case is open, which includes an air inlet partition and the air inlet formed on the air inlet partition.

2. The vertical lighting vaneless inverter fan according to claim 1, wherein the top of the air supply column and the lamp post are detachably connected through a connector.

3. The vertical lighting vaneless inverter fan according to claim 1, wherein the illuminating lamp includes a lamp housing and a luminous element disposed inside the lamp housing; the lamp housing is detachably assembled on the top of the lamp post, and the light of the luminous element are diffused through the lamp housing.

4. The vertical lighting vaneless inverter fan according to claim 3, wherein the lamp housing includes a mounting slot and a reading light detachably mounted in the mounting slot.

5. The vertical lighting vaneless inverter fan according to claim 1, wherein the air inlet partition is in an annular shape, includes an annular upper spacer, an annular lower spacer, and a dust screen; the upper spacer and lower spacer are detachably connected by stacking; the upper spacer and lower spacer separately include the air inlet; the dust screen is disposed between the upper spacer and lower spacer; when the upper spacer and lower spacer are disassembled and opened, the dust screen can be removed and replaced.

6. The vertical lighting vaneless inverter fan according to claim 1, wherein motor mounting bracket includes a cover, an inside of the cover is a hollow motor mounting position, a lower end face of the cover is an open structure for disassembling motor, the motor is assembled in the motor mounting position through an opening at a lower end of cover, an output shaft of motor extends upward through a top of the cover.

7. The vertical lighting vaneless inverter fan according to claim 6, wherein a bottom of the cover is installed in an annular center of the air inlet partition, and the cover is evenly provided with heat dissipation holes.

8. The vertical lighting vaneless inverter fan according to claim 7, wherein an inner wall of the cover includes a first sound-reducing cotton.

9. The vertical lighting vaneless inverter fan according to claim 1, wherein an inside the body case is configured with a sound-reducing structure; the sound-reducing structure has a sound-reducing chamber and the sound-reducing chamber includes the blast system.

10. The vertical lighting vaneless inverter fan according to claim 9, wherein the sound-reducing structure includes a truncated cone shaped sound-reducing mount, a second sound-reducing cotton mounted an outside of the sound-reducing mount, and a sound-reducing chamber disposed inside the sound-reducing mount; the inside of the sound-reducing mount is attached to the outer wall of the sound-reducing mount; the outer side of the sound-reducing mount is disposed with a plurality of annular wave patterns.

11. The vertical lighting vaneless inverter fan according to claim 10, wherein the upper end and lower end of the sound-reducing mount are respectively disposed with a supporting ring towards the outer ring to press against the body case; an installation space with second sound-reducing cotton is configured between the upper and lower supporting ring plate;

a mount air outlet is provided at the top of the sound-reducing mount; the mount air outlet can link up with the air outlet of the body case; the sound-reducing mount is disposed with an open configuration, which is provided with a blast system inside the sound-reducing chamber.

12. The vertical lighting vaneless inverter fan according to claim 1, wherein the air supply column is configured on the air outlet of the body case through a joint sleeve, the air supply column including:

an outlet tube, an opening is provided lengthways along the side of the outlet tube and is connected to the inside of the outlet tube;

an air guide component, which is laterally inserted in the opening of outlet tube; an air guide face is formed on the air guide component;

a narrow air supply slit is formed between the tube wall at the opening of the outlet tube and the air guide face of the air guide component.

13. The vertical lighting vaneless inverter fan according to claim 12, wherein air guide component forms a dual-inlet space inside the outlet tube, and the outlet slit corresponds to the configuration of the inlet space; the outlet tube has a C-shaped tube, bending and extending inwards along the opening of tube to form two symmetrical side plates; the air guide component is located between the two side plates in the outlet tube;

the air guide component has two air deflectors corresponding to side plate, and the narrow air supply slit is formed between the side plate and air deflector; the air guide face is formed on the air deflector, and the airflow in the outlet tube is guided by the air guide face and jetted out of the narrow air supply slit;

a slot is provided in the inner wall of tube, the edges of air deflector are inserted in the slots to assemble the air guide component.

14. The vertical lighting vaneless inverter fan according to claim 1, wherein the air supply column is connected to the body case by a joint sleeve, the top of the joint sleeve is provided with a plug hole for assembling the air supply column and matching the shape of air supply column; the joint sleeve is assembled at the top of body case and connected to the air outlet of body case; the air supply column is connected to the air outlet of the body case by the joint sleeve;

the end wall of body case is provided with positioning lugs with cylindrical slots, correspondingly, plug pins are disposed at the bottom of the joint sleeve, the plug pins are inserted in the cylindrical slots of the positioning lugs to guide the joint sleeve to the top of the body case;

a groove is provided downward of the end wall of the body case, an elastic buckle is located in the groove; the top of the joint sleeve is provided with a buckle part matching the elastic buckle, the elastic buckle and buckle part coordinate with each other to affix the joint sleeve to the top of body case.

15. The vertical lighting vaneless inverter fan according to claim 1, wherein the inside of the body is provided with circuit module;

the lighting device is electrically connected to the circuit module inside the body;

the inside of the lamp housing of the lighting device is provided with independent circuit module;

the body is disposed with a control panel.

16. The vertical lighting vaneless inverter fan according to claim 1, comprising a base, the body is rotatably mounted on the base.

* * * * *